US005635325A

United States Patent [19]

Inaba et al.

[11] Patent Number: 5,635,325

[45] Date of Patent: Jun. 3, 1997

[54] TONER FOR DEVELOPING ELECTROSTATIC IMAGES AND IMAGE FORMING METHOD

[75] Inventors: Kohji Inaba, Yokohama; Tatsuya Nakamura, Tokyo; Tatsuhiko Chiba, Kamakura; Takao Ishiyama, Kawasaki; Kengo Hayase, Tokyo, all of Japan

[73] Assignee: Canon Kabushiki Kaisha, Tokyo, Japan

[21] Appl. No.: 452,344

[22] Filed: May 26, 1995

[30] Foreign Application Priority Data

May 31, 1994 [JP] Japan ..... 6-139665

[51] Int. Cl.[6] ..... G03G 13/16; G03G 9/097

[52] U.S. Cl. ..... 430/106; 430/126

[58] Field of Search ..... 430/106, 109, 430/110, 126

[56] References Cited

U.S. PATENT DOCUMENTS

| | | | |
|---|---|---|---|
| 4,917,782 | 4/1990 | Tomono et al. | 430/99 |
| 5,130,219 | 7/1992 | Mori et al. | 430/106 |
| 5,219,697 | 6/1993 | Mori et al. | 430/110 |
| 5,225,303 | 7/1993 | Tomita et al. | 430/106.6 |
| 5,368,972 | 11/1994 | Yamashita et al. | 430/137 |

FOREIGN PATENT DOCUMENTS

| | | |
|---|---|---|
| 2644850 | 4/1977 | Germany . |
| 36-10231 | 11/1961 | Japan . |
| 52-3304 | 1/1977 | Japan . |
| 52-3305 | 1/1977 | Japan . |
| 56-13945 | 4/1981 | Japan . |
| 57-52574 | 11/1982 | Japan . |
| 59-53856 | 3/1984 | Japan . |
| 59-61842 | 4/1984 | Japan . |
| 1-185660 | 7/1989 | Japan . |
| 1-185661 | 7/1989 | Japan . |
| 1-185662 | 7/1989 | Japan . |
| 1-185663 | 7/1989 | Japan . |
| 1-238672 | 9/1989 | Japan . |
| 4-107467 | 4/1992 | Japan . |
| 4-149559 | 5/1992 | Japan . |
| 4-301853 | 10/1992 | Japan . |
| 5-61238 | 3/1993 | Japan . |

*Primary Examiner*—John Goodrow

*Attorney, Agent, or Firm*—Fitzpatrick, Cella, Harper & Scinto

[57] ABSTRACT

A toner for developing electrostatic images includes: at least a binder resin, a colorant and an ester wax. The ester wax is contained in 3–40 wt. parts per 100 wt. parts of the binder resin. The ester wax includes ester compounds represented by a formula of $$R_1—COO—R_2,$$

wherein $R_1$ an $R_2$ independently denote a hydrocarbon group of 15–45 carbon atoms. The ester wax contains 50–95 wt. % thereof of ester compounds having an identical number of total carbon atoms. The toner is especially characterized by low-temperature fixability, wide non-offset temperature range, good color mixing characteristic and transparency.

67 Claims, 4 Drawing Sheets

TONER FOR DEVELOPING ELECTROSTATIC IMAGES AND IMAGE FORMING METHOD

FIELD OF THE INVENTION AND RELATED ART

The present invention relates to a toner for developing electrostatic images suitable for forming a toner image according to electrophotography, electrostatic recording, etc., and allowing efficient fixation of the toner image onto a transfer-receiving material, and an image forming method using the toner.

In full-color copying apparatus proposed in recent years, there have been generally used a full-color image forming method wherein four photosensitive members and a belt transfer member are used, electrostatic images formed on the respective photosensitive members are developed with cyan toner, magenta toner, yellow toner and black toner, respectively, and a transfer-receiving material is conveyed between the photosensitive members and the belt transfer member to cause transfer in a straight path; and a full-color image forming method wherein a transfer-receiving material is wound about the surface of a transfer member disposed opposite to a photosensitive member by the action of an electrostatic force or a mechanical force like that of a gripper, and development-transfer steps are effected four times.

Toners used in such a full-color copying apparatus are required to show a good color reproducibility and also sufficient color-mixing characteristic among the respective colors in a hot-pressure fixing step without impairing a clarity required for overhead projector (OHP) images. Compared with a black toner for ordinary monochromatic copying apparatus, a toner for full-color image formation preferably comprises a low-molecular weight binder resin having a sharp-melting characteristic. However, an ordinary sharp-melting binder resin shows only a low self-cohesion so that it is liable to cause a problem in anti-high-temperature offset characteristic when the toner is melted in a hot-pressure fixing step. In an ordinary black toner for monochromatic copying apparatus, a wax component having a relatively high crystallinity as represented by polyethylene wax or polypropylene wax is used as a release agent as proposed in, e.g., Japanese Patent Publication (JP-B) 52-3304, JP-B 52-3305 and Japanese Laid-Open Patent Application (JP-A) 57-52574. However, in a toner for full-color image formation, because of a high crystallinity of the release agent per se or a difference in refractive index from an OHP sheet, the clarity of a projected image is impaired to result in projected images having low saturation and brightness.

In order to solve the above problem, it has been proposed to use a nucleating agent together with a wax to lower the crystallinity of the wax in JP-A 4-149559 and JP-A 4-107467. Further, the use of a wax having a low crystallinity has been proposed in JP-A 4-301853 and JP-A 5-61238. As a wax having relatively good transparency and low melting point, montan wax has been known and proposed to be used in JP-A 1-185660, JP-A 1-185661, JP-A 1-185662, JP-A 1-185663 and JP-A 1-238672. These waxes, however, do not sufficiently satisfy all of clarity for OHP sheets and low-temperature fixability and anti-high temperature offset characteristic required in hot-pressure fixation. For this reason, in an ordinary color toner, the use of a release agent is minimized but it has been practiced to apply an oil, such as silicone oil or fluorine-containing oil onto hot-fixation rollers to improve the anti-high temperature offset characteristic and the clarity for OHP. However, the thus-fixed images carry excessive oil on the surface thereof. Further, the oil is liable to attach and soil the photosensitive member, and swell the fixing roller to shorten the life of the fixing roller. Further, in order to prevent oil streaks on the fixed images, it is necessary to supply the oil onto the fixing roller uniformly and at a constant rate. However, this is liable to require a larger fixing device.

For this reason, it has been desired to provide a toner capable of effectively preventing the occurrence of offset in a hot-fixing means using no or little oil for preventing high-temperature offset and also capable of providing fixed images excellent in clarity.

SUMMARY OF THE INVENTION

A generic object of the present invention is to provide a toner for developing electrostatic images and an image forming method having solved the above mentioned problems.

A more specific object of the present invention is to provide a toner for developing electrostatic images capable of providing OHP sheets excellent in clarity and having an excellent anti-high temperature offset characteristic.

Another object of the present invention is to provide a toner for developing electrostatic images excellent in low-temperature fixability.

A further object of the present invention is to provide a toner for developing electrostatic images excellent in anti-blocking characteristic.

According to the present invention, there is provided a toner for developing electrostatic images, comprising: at least a binder resin, a colorant and an ester wax; wherein said ester wax is contained in 3–40 wt. parts per 100 wt. parts of the binder resin, said ester wax comprises ester compounds represented by a formula of $$R_1—COO—R_2,$$

wherein $R_1$ an $R_2$ independently denote a hydrocarbon group of 15–45 carbon atoms, and said ester wax contains 50–95 wt. % thereof of ester compounds having an identical number of total carbon atoms.

According to another aspect of the present invention, there is provided an image forming method, comprising:

forming an electrostatic image on an electrostatic image-bearing member, developing the electrostatic image with a toner as described above to form a toner image on the electrostatic image-bearing member, transferring the toner image from the electrostatic image-bearing member to a transfer-receiving material directly or via an intermediate transfer member, and fixing the toner image onto the transfer-receiving material under application of heat and pressure.

These and other objects, features and advantages of the present invention will become more apparent upon a consideration of the following description of the preferred embodiments of the present invention taken in conjunction with the accompanying drawings.

DETAILED DESCRIPTION OF THE INVENTION

In order to exhibit improved low-temperature fixability and anti-offset characteristic and provide a fixed color image on an OHP film with an improved clarity or transparency, the toner contains an ester wax comprising ester compounds represented by the following formula:

$$R_1—COO—R_2,$$

s wherein $R_1$ and $R_2$ independently denote a hydrocarbon group of 15–45 carbon atoms in such a proportion that ester compounds having an identical number of total carbon atoms occupy 50–95 wt. % of the ester wax.

The content of the ester compounds having an identical number of carbon atoms may be measured by gas chromatography (GC) and the values described herein are those measured according to the following method by using an apparatus ("GC-17A", available from Shimazu Seisakusho K. K.).

A sample is preliminarily dissolved in toluene at a concentration of 1 wt. %, and 1 μl of the solution is injected into the apparatus equipped with an on-column injector. The column used is Ultra Alloy-1 (HT) having sizes of 0.5 mm-dia.×10 m-length. The column is initially heated at a rate of 40° C./min. from 40° C. to 200° C., then at a rate of 15° C./min. to 350° C., and then at a rate of 7° C./min. to 450° C. He (helium) gas is caused to flow as a carrier gas at a pressure of 50 kPa. The ester compounds are identified by comparison with chromatograms of alkanes having a known number of carbon atoms prepared in advance by the same apparatus and the results of mass spectrum chromatography of the gassified components thereof. The content of an ester compound is calculated as a ratio of the peak area thereof to a total area of peaks in a chromatogram of the sample wax.

Figure 3:
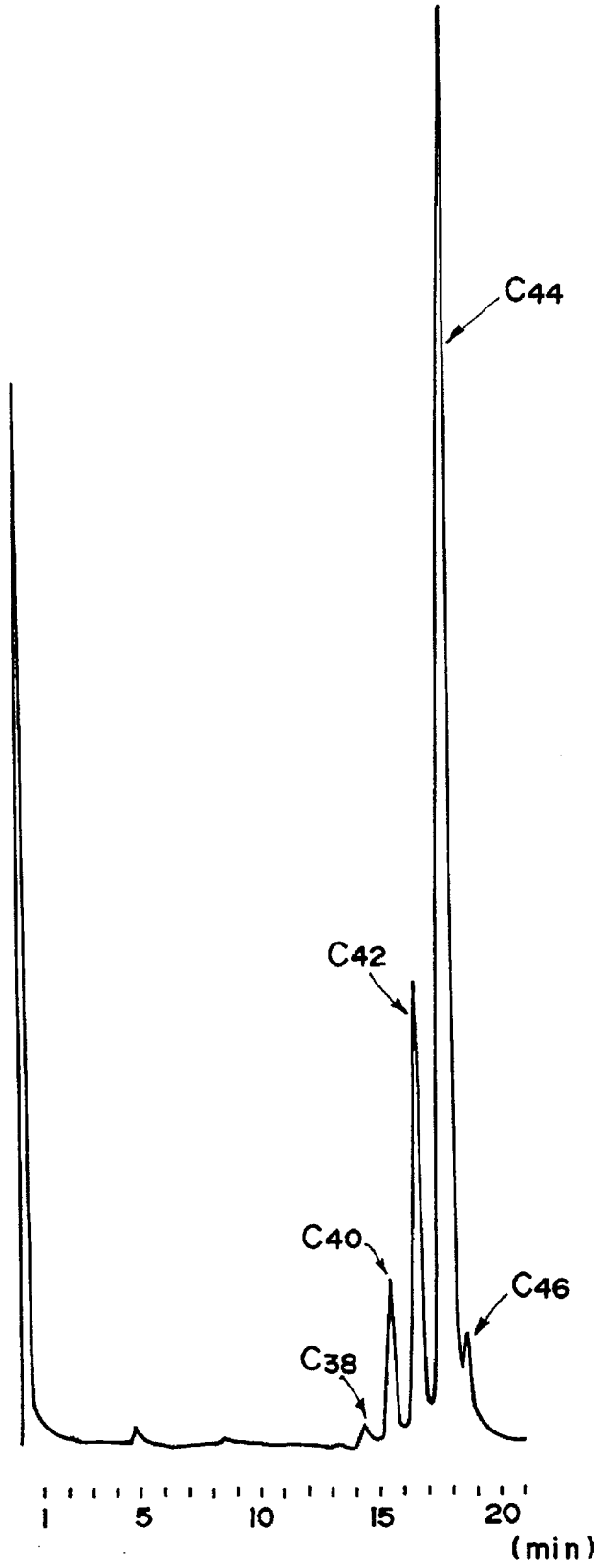
FIGS. 3 and 4 respectively show a gas chromatogram of an ester wax used in the present invention.

An example of gas chromatogram of an ester wax is shown in FIG. 3. FIG. 3 shows that the ester wax contains:

1) ca. 0.6 wt. % of ester compounds having a total of 38 carbon atoms and represented by $$CH_3\text{-}(CH_2)_{18}COO\text{-}(CH_2)_{17}CH_3,$$

and $$CH_3\text{-}(CH_2)_{16}COO\text{-}(CH_2)_{17}CH_3,$$

2) ca. 5.8 wt. % of ester compounds having a total of 40 carbon atoms and represented by $$CH_3\text{-}(CH_2)_{18}COO\text{-}(CH_2)_{19}CH_3,$$

$$CH_3\text{-}(CH_2)_{20}COO\text{-}(CH_2)_{17}CH_3,$$

and $$CH_3\text{-}(CH_2)_{16}COO\text{-}(CH_2)_{21}CH_3,$$

3) ca. 19.0 wt. % of ester compounds having a total of 42 carbon atoms and represented by $$CH_3\text{-}(CH_2)_{22}COO\text{-}(CH_2)_{17}CH_3,$$

$$CH_3\text{-}(CH_2)_{18}COO\text{-}(CH_2)_{21}CH_3,$$

and $$CH_3\text{-}(CH_2)_{20}COO\text{-}(CH_2)_{19}CH_3,$$

4) ca. 72.9 wt. % of ester compounds having a total of 44 carbon atoms and represented by $$CH_3\text{-}(CH_2)_{22}COO\text{-}(CH_2)_{19}CH_3,$$

$$CH_3\text{-}(CH_2)_{20}COO\text{-}(CH_2)_{21}CH_3,$$

and 5) ca. 1.7 wt. % of an ester compound having a total of 46 carbon atoms and represented by $$CH_3\text{-}(CH_2)_{22}COO\text{-}(CH_2)_{21}CH_3.$$

In this way, the sample ester wax has been found to contain, as a principal constituent, ca. 72.6 wt. % of an ester compound having a total of 44 carbon atoms and represented by $CH_2\text{-}(CH_2\text{-})_{20}COO\text{-}(CH_2\text{-})_{21}CH_3$.

The ester wax used in the present invention is generally synthesized from a higher alcohol component and a higher carboxylic acid component. The higher alcohol and higher carboxylic acid components have been obtained from a natural product in many cases and are generally composed of a mixture of components having even numbers of carbon atoms. When the mixture is esterified as it is, the resultant esterified product contains, in addition to an objective ester compound, various by-products of analogous structures, which are liable to adversely affect the various performances of the resultant toner. For this reason, the ester wax used in the present invention may be obtained through purification of starting materials and product-by-solvent extraction or distillation under a reduced pressure.

In case where the content of the ester compounds having an identical number of carbon atoms is below 50 wt. %, a complicated variety of crystal forms and a lowering in solidifying point are liable to cause an adverse effect principally on the anti-blocking characteristic and developing performance of the toner. More specifically, in the mono-component developing system, the toner melt-sticking is liable to occur on the developing sleeve, thus being liable to result in streak-like image defects in the resultant images extending in a circumferential direction of the sleeve. Also in the two-component developing system, filming attributable to the wax is liable to occur on the carrier particles or the photosensitive member surface, thus causing a lowering in toner triboelectric charge and failing to continuously provide a sufficient triboelectric charge.

The ester compounds having an identical number of total carbon atoms may preferably constitute 55–95 wt. %, further preferably 60–95 wt. %, of the ester wax so as to provide a good transparency and a prescribed hue of a color toner image. It is further preferred that ester compounds having a number of carbon atoms in a range of the above-mentioned identical number (the number of carbon atoms in a principal ester compound) ±2 occupy 80–95 wt. %, more preferably 90–95 wt. %, of the ester wax.

It is particularly preferred that ester compounds represented by $R_1'$—COO—$R_2'$ (wherein $R_1'$ and $R_2'$ independently denote a linear long-chain alkyl group having 15–28 carbon atoms) and having a total of 44 carbon atoms occupy 50–95 wt. % of the ester wax.

Among the ester compounds constituting the ester wax and represented by $R_1$—COO—$R_2$, those including the group $R_1$ and/or $R_2$ which are saturated hydrocarbon groups, particularly linear alkyl groups, are preferred. It is particularly preferred to use ester compounds including a group $R_1$ of a linear alkyl having 15–45 carbon atoms and a group $R_2$ of a linear alkyl having 16–44 carbon atoms. Preferred examples of the ester compounds may include those represented by the following formulae:

$CH_3\ (CH_2)_{16}\ COO\ (CH_2)_{17}\ CH_3$
$CH_3\ (CH_2)_{18}\ COO\ (CH_2)_{17}\ CH_3$
$CH_3\ (CH_2)_{16}\ COO\ (CH_2)_{19}\ CH_3$
$CH_3\ (CH_2)_{18}\ COO\ (CH_2)_{19}\ CH_3$
$CH_3\ (CH_2)_{20}\ COO\ (CH_2)_{17}\ CH_3$
$CH_3\ (CH_2)_{16}\ COO\ (CH_2)_{21}\ CH_3$
$CH_3\ (CH_2)_{22}\ COO\ (CH_2)_{17}\ CH_3$
$CH_3\ (CH_2)_{18}\ COO\ (CH_2)_{21}\ CH_3$
$CH_3\ (CH_2)_{20}\ COO\ (CH_2)_{19}\ CH_3$
$CH_3\ (CH_2)_{22}\ COO\ (CH_2)_{19}\ CH_3$
$CH_3\ (CH_2)_{20}\ COO\ (CH_2)_{21}\ CH_3$
$CH_3\ (CH_2)_{22}\ COO\ (CH_2)_{21}\ CH_3$
$CH_3\ (CH_2)_{14}\ COO\ (CH_2)_{44}\ CH_3$
$CH_3\ (CH_2)_{27}\ COO\ (CH_2)_{21}\ CH_3$
$CH_3\ (CH_2)_{43}\ COO\ (CH_2)_{21}\ CH_3$

The ester wax comprising ester compounds $R_1$—COO—$R_2$ may preferably show a main peak temperature on a heat-absorption curve obtained according to ASTM D3418-8 (hereinafter called "melting point") of 40°–90° C., more preferably 55°–85° C., in view of the low-temperature temperature fixability and anti-offset characteristic of the resultant toner.

An ester wax having a melting point of below 40° C. is liable to show a weak self-cohesion, thus resulting in an inferior anti-high-temperature offset characteristic. On the other hand, an ester wax showing a melting point exceeding 90° C. is liable to require a high fixing temperature, thus making it difficult to appropriately smoothen the fixed image surface and resulting in a lower color-mixing characteristic. Further, in the case of producing toner particles through direct polymerization including particle formation and polymerization in an aqueous medium, an ester wax having a high melting point is liable to cause precipitation, thus making it difficult to provide a sharp particle size distribution.

The melting point measurement according to ASTM D3418-8 may be performed by using a differential scanning calorimeter (e.g., "DSC-7" available from Perkin Elmer Co.). The temperature correction of the detector may be performed by using the melting points of indium and zinc, and the heat capacity correction may be performed by using the heat of fusion of indium. A sample is placed in an aluminum pan and a blank pan is set for a reference purpose. The measurement may be performed at a temperature raising rate of 10° C./min.

The ester wax used in the present invention may preferably have a hardness of 0.5–5.0. The hardness mentioned herein refers to a Vickers hardness of a sample ester wax shaped into a cylindrical pellet of 20 mm in diameter and 5 mm in thickness as measured by a dynamic ultra-minute hardness meter ("DUH-200" available from Simazu Seisakusho K. K.). The measurement may be made under a load of 0.5 g and a loading speed of 9.67 mm/sec to cause a displacement of 10 μm, followed by holding for 15 sec., to measure the shape of the resultant cavity to measure a Vickers hardness.

An ester wax having a hardness of below 0.5 is liable to show a fixing performance which shows a large dependence on a fixing pressure and a process speed, thus being liable to provide an inferior anti-high-temperature offset characteristic. On the other hand, a hardness in excess of 5.0 leads to a lower storage stability of a toner and a low self-cohesion of the ester wax per se, thus providing a low anti-high-temperature offset characteristic.

The ester wax may preferably have a weight-average molecular weight (Mw) of 200–2000, more preferably 300–1000, and a number-average molecular weight (Mn) of 150–2000, more preferably 250–1000. In case where Mw is below 200 and Mn is below 150, the resultant toner is liable to have a lower anti-blocking characteristic. In case where Mw exceeds 2000 and Mn exceeds 2000, the ester wax per se is liable to develop crystallinity and is liable to provide a lower clarity.

The molecular weight distribution of wax may be obtained based on measurement by GPC (gel permeation chromatography), e.g., under the following conditions:

Apparatus: "GPC-150C" (available from Waters Co.)

Column: "GMH-HT" 30 cm-binary (available from Toso K. K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained first based on a calibration curve prepared by monodisperse polystyrene standard samples, and recalculated into a distribution corresponding to that of polyethylene using a conversion formula based on the Mark-Houwink viscosity formula.

The ester wax may be added in an amount of 3–40 wt. parts per 100 wt. parts of the binder resin in view of a case of obtaining fixed images on double or both sides of a sheet. In a double side-fixing method, a fixed image is formed on a first surface of a transfer paper sheet and then a further fixed image is formed on a second surface of the sheet. In this case, a once-fixed surface toner image is passed again through a fixing device, so that a further attention should be paid to the anti-high-temperature offset characteristic of the toner. Also for this purpose, the toner according to the present invention may preferably contain a relatively large amount of ester wax.

Below 3 wt. parts, the anti-high-temperature offset characteristic is liable to be lowered, and, in the double side fixing method, the image on the second surface is liable to cause offset. In excess of 40 wt. parts, melt-sticking is liable to be caused in a toner production apparatus according to the pulverization process. Also in toner production according to the polymerization process, coalescence of toner particles during the toner particle formation step is liable to occur, thus resulting in a toner having a broad particle size distribution. Further, in excess of 40 wt. parts, the toner is liable to show a lower durability.

A toner containing 3–40 wt. parts, preferably 5–35 wt. parts, of the ester wax may show a suppressed toner melt-sticking or filming onto a photosensitive member or an intermediate transfer member in a full-color image forming method wherein a developed toner image formed of such toner particles on the photosensitive member is transferred to the intermediate transfer member, the toner image on the intermediate transfer member is electrostatically transferred onto a transfer-receiving material (such as plain paper) with which a transfer roller supplied with a voltage is placed in contact, and the toner image on the transfer-receiving material is fixed onto the material by heat and pressure application means.

In the present invention, the binder resin may comprise various resins such as styrene-(meth)acrylate copolymer, polyester resin, epoxy resin and styrene-butadiene copolymer.

In the case of directly producing the toner particles through the polymerization process, the monomer may preferably be a vinyl-type monomer, examples of which may include: styrene and its derivatives such as styrene, o-, m- or p-methyl-styrene, and m- or p-ethylstyrene; (meth) acrylic acid esters such as methyl (meth)acrylate, ethyl (meth)acrylate, propyl (meth)acrylate, butyl (meth)acrylate, octyl (meth)acrylate, dodecyl (meth)acrylate, 2-ethylhexyl (meth)acrylate, stearyl (meth)acrylate, behenyl (meth) acrylate, dimethyl-aminoethyl (meth)acrylate, and diethylaminoethyl (meth)acrylate; butadiene; isoprene; cyclohexene; (meth)acrylonitrile, and acrylamide. These monomers may be used singly or in mixture of two or more species.

The above monomers may be used singly or in appropriate mixture so as to provide a theoretical glass transition point (Tg), described in "POLYMER HANDBOOK", second addition, III-pp. 139–192 (available from John Wiley & Sons Co.), of 40°–75° C. If the theoretical glass transition point is below 40° C., the resultant toner particles are lowered in storage stability and durability. On the other hand, the theoretical glass transition point is in excess of 75° C., the fixation temperature of the toner particles is increased, whereby respective color toner particles have an insufficient color-mixing characteristic, particularly in the case of the full-color image formation. As a result, the resultant toner particles have a poor color reproducibility and undesirably lower a transparency of an OHP film image.

In the present invention, the molecular-weight distribution of the binder resin may be measured by gel permeation chromatography (GPC) as follows. The toner particles are subjected to extraction with toluene for 20 hours by means of Soxhlet extractor in advance, followed by distilling-off of the solvent (toluene) from the extract liquid to recover a solid. An organic solvent (e.g.,chloroform) in which ester wax is dissolved but the binder resin is not dissolved is added to the solid and sufficiently washed therewith to obtain a residue product. The residue product is dissolved in tetrahydrofuran (THF) and subjected to filtration with a solvent-resistant membrane filter having a pore size of 0.3 μm to obtain a sample solution (THF solution) The sample solution is injected in a GPC apparatus ("GPC-150C", available from Waters Co.) using columns of A-801, 802, 803, 804, 805, 806 and 807 (manufactured by Showa Denko K. K.) in combination. The identification of sample molecular weight and its molecular weight distribution is performed based on a calibration curve obtained by using monodisperse polystyrene standard samples. In the present invention, the binder resin (THF-soluble) may preferably have a number-average molecular weight (Mn) of 5,000–1,000,000 and a ratio of weight-average molecular weight (Mw) to Mn (Mw/Mn) of 2–100.

In the present invention, it is particularly preferred that the ester wax is enclosed within the binder resin. For this purpose, it is particularly preferred to add a polar resin in the toner particles. Preferred examples of such a polar resin may include styrene-(meth)acrylate copolymer, maleic acid-based copolymer, saturated polyester resin and epoxy resin. The polar resin may particularly preferably have no unsaturated group capable of reacting with the binder resin or a vinyl monomer constituting the binder resin. This is because if the polar resin has an unsaturated group, the unsaturated group can cause a crosslinking reaction with the vinyl monomer, thus resulting in a binder resin providing a toner showing a poor color-mixing characteristic.

The colorant used in the present invention may include a black colorant, yellow colorant, a magenta colorant and a cyan colorant.

Examples of the black colorant may include: carbon black, a magnetic material, and a colorant showing black by color-mixing of yellow/magenta/cyan colorants as shown below.

Examples of the yellow colorant may include: condensed azo compounds, isoindolinone compounds, anthraquinone compounds, azo metal complexes, methine compounds and arylamide compounds. Specific preferred examples thereof may include C.I. Pigment Yellow 12, 13, 14, 15, 17, 62, 74, 83, 93, 94, 95, 109, 110, 111, 120, 127, 128, 129, 147, 168, 174, 176, 180, 181 and 191.

Examples of the magenta colorant may include: condensed azo compounds, diketopyrrolpyrrole compounds, anthraquinone compounds, quinacridone compounds, basic dye lake compounds, naphthol compounds, benzimidazole compounds, thioindigo compounds and perylene compounds. Specific preferred examples thereof may include: C.I. Pigment Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compounds and their derivatives, anthraquinone compounds and basic dye lake compounds. Specific preferred examples thereof may include: C.I. Pigment Blue 1, 7, 15, 15:1, 15:2, 15:3, 15:4, 60, 62, and 66.

These colorants may be used singly or in combination of two or more species in mixture or in a state of solid solution. The above colorants may be appropriately selected in view of hue, color saturation, color value, weather resistance, transparency of OHP film, and a dispersibility in toner particles. The above colorants may preferably be used in a proportion of 1–20 wt. parts per 100 wt. parts of the binder resin. A black colorant comprising a magnetic material, unlike the other colorants, may preferably be used in a proportion of 40–150 wt. parts per 100 wt. parts of the binder resin.

The charge control agent used as desired in the present invention may preferably be one which is colorless and has a higher charging speed and a property capable of stably retaining a prescribed charge amount. In the case of using the direct polymerization for producing the toner particles of the present invention, the charge control agent may particularly preferably be one free from polymerization-inhibiting properties and not containing a component soluble in an aqueous medium.

The charge control agent used in the present invention may be those of negative-type or positive-type. Specific examples of the negative charge control agent may include: metal-containing acid-based compounds comprising acids, such as salicylic acid, alkylsalicylic acid, dialkylsalicylic acid, naphtoic acid, dicarboxylic acid and derivatives of these acids; polymeric compounds having a side chain comprising sulfonic acid or carboxylic acid; boron compound; urea compounds; silicon compound; and calixarene. Specific examples of the positive charge control agent may include: quaternary ammonium salts; polymeric compounds having a side chain comprising quaternary ammonium salts; guanidine compounds; and imidazole compounds.

The charge control agent may preferably be used in a proportion of 0.5–10 wt. parts per 100 wt. parts of the binder resin. However, the charge control agent is not an essential component of the toner in the present invention. The charge control agent can be used as an optional additive in some cases. In the case of using a two-component developing method, it is possible to utilize triboelectric charging with a carrier. In the case of using a non-magnetic one-component blade coating developing method, it is possible to omit a charge control agent by positively utilizing a triboelectric charge through friction with a blade member or a sleeve member.

Examples of the polymerization initiator usable in the direct polymerization may include: azo- or diazo-type polymerization initiators, such as 2,2'-azobis-(2,4-dimethylvaleronitrile), 2,2'-azobisisbutyronitrile, 1,1'-azobis (cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. The addition amount of the polymerization initiator varies depending on a polymerization degree to be attained. The polymerization initiator may generally be used in the range of about 0.5–20 wt. % based on the weight of the polymerizable monomer. The polymerization initiators somewhat vary depending on the polymerization process used and may be selectively used singly or in mixture with reference to 10-hour half-life period temperature.

In order to control the molecular weight of the resultant binder resin, it is also possible to add a crosslinking agent, a chain transfer agent, a polymerization inhibitor, etc.

The toner particles of the present invention may be produced by various methods including: (i) pulverization and classification process wherein a toner composition comprising a binder resin, an ester wax, a colorant, a charge control agent, etc. is uniformly dispersed by a dispersing device, such as a pressure kneader or an extruder and finely pulverized into a desired toner particle size by impingement of the toner composition against a target by the action of mechanical force or jet air stream, followed by classification to obtain toner particles having a sharp particle size distribution; (ii) melt-spraying method: wherein a melt mixture of toner ingredients is sprayed in the air by using a disk or a fluidic multi-nozzle to obtain spherical toner particles (as disclosed in Japanese Patent Publication (JP-B) 56-13945); and (iii) direct polymerization process inclusive of: (a) suspension polymerization for directly providing toner particles as disclosed in JP-B 36-10231, JP-A 59-53856, and JP-A 59-61842, (b) dispersion polymerization wherein an aqueous organic solvent in which a monomer is soluble but a polymer is insoluble is used to directly obtain toner particles, and (c) emulsion polymerization, such as soap-free polymerization, wherein a polymerizable monomer composition is polymerized in the presence of a watersoluble polar polymerization initiator to obtain toner particles.

Among the above production methods, it is however difficult to control the shape of the resultant toner particles by the pulverization and classification process. In the melt-spraying method, the resultant toner particles are liable to have a wider particle size distribution, and a large amount of energy is consumed in the melting step, so that this method is not preferred from a viewpoint of effective energy utilization. In the dispersion polymerization, the resultant toner particles show a very sharp particle size distribution but the production apparatus is liable to be complicated in view of a narrow latitude in selecting material used, waste solvent disposal and flammability of the solvent used. The emulsion polymerization or soap-free polymerization is effective in providing a relatively uniform particle size distribution but is liable to result in inferior environmental characteristics due to the presence of the emulsifying agent or polymerization initiator at the surface of the toner particles.

The toner according to the present invention may particularly preferably be produced through the suspension polymerization process by which a particulate toner having a small particle size of 3–8 μm can be easily produced with a uniformly controlled shape and a sharp particle size distribution. It is also possible to suitably apply the seed polymerization process wherein once-obtained polymerizate particles are caused to adsorb a monomer, which is further polymerized in the presence of a polymerization initiator. It is also possible to include a polar compound in the monomer adsorbed by dispersion or dissolution.

In case where the toner according to the present invention is produced through the suspension polymerization process, toner particles may be produced directly in the following manner. Into a polymerizable monomer, an ester wax, a colorant, a charge control agent, a polymerization initiator and another optional additive are added and uniformly dissolved or dispersed by a homogenizer or an ultrasonic dispersing device, to form a polymerizable monomer composition, which is then dispersed and formed into particles in a dispersion medium containing a dispersion stabilizer by means of an ordinary stirrer, a homomixer or a homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50°–90° C. The temperature can be raised at a later stage of the polymerization. It is also possible to subject a part of the aqueous system to distillation in a latter stage of or after the polymerization in order to remove the yet-polymerized part of the polymerizable monomer and a by-product which can cause an odor in the toner fixation step. After the reaction, the produced toner particles are washed, filtered out, and dried. In the suspension polymerization, it is generally preferred to use 300–3000 wt. parts of water as the dispersion medium per 100 wt. parts of the monomer composition.

In production of toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt and starch. These dispersion stabilizers may preferably be used in the aqueous dispersion medium in an amount of 0.2–20 wt. parts per 100 wt. parts of the polymerizable monomer mixture.

In the case of using an inorganic dispersion stabilizer, a commercially available product can be used as is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under intensive stirring to produce tricalcium phosphate particles in the aqueous medium, suitable for suspension polymerization.

In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

The toner according to the present invention may preferably have a shape factor SF-1 of 100–160, particularly 100–150. The shape factor SF-1 referred to herein is based on values measured in the following manner.

Images of 100 toner particles observed through a field emission scanning electron microscope (FE-SEM) ("S-800", available from Hitachi Seisakusho K. K.) at a magnification of, e.g., 500 are sampled at random, and the image data of the toner images are inputted for analysis into an image analyzer (e.g., "Luzex III", available from Nireco K. K.) through an interface, whereby the shape factor SF-1 is calculated by the following equation:

$$SF\text{-}1=[(MXLNG)^2/AREA]\times(\pi/4)\times 100,$$

wherein MXLNG denotes the maximum diameter of a toner particle and AREA denotes the projection area of the toner particle. The shape factor SF-1 referred to herein is defined as a number-average value of SF-1 values calculated in the above-described manner for 100 toner particles selected at random. A smaller shape factor (closer to 100) represents a shape closer to a true sphere.

In case where the shape factor SF-1 is larger than 160, the toner particles are substantially deviated from spheres and approach indefinite or irregularly shaped particles and correspondingly show a lowering in transfer efficiency (or transfer ratio).

Particularly in the case of using an intermediate transfer member so as to be applicable to a wide variety of transfer-receiving materials, substantially two transfer steps are involved, so that a lower transfer ratio results in a lowering in toner utilization efficiency. Further, in a digital full-color copying machine or a digital full-color printer recently developed, it is necessary that a color image original is preliminarily subjected to color separation by using B (blue), G (green) and R (red) filters, and dot latent images of 20–70 μm are formed on a photosensitive member and developed with respective toners in colors of Y (yellow), M (magenta), C (cyan) and B (black), respectively, to reproduce a multi-color image faithful to the original or color data by subtractive color mixing of the toners. In this instance, large quantities of Y, M, C and B toners corresponding to the original or color data from CRT are present on the photosensitive member or intermediate transfer member, so that the respective color toners used in the present invention are required to show a very high transferability. For maintaining such a good transferability, the toner should preferably contain the above-mentioned ester wax and a shape factor SF-1 of 100–160.

Further, in order to faithfully reproduce minute latent image dots for providing a high quality image, the toner according to the present invention may preferably have a weight-average particle size of 3–8 μm and a number-basis variation coefficient of particle size of at most 35%. A toner having a weight-average particle size of below 3 μm is liable to show a low transfer ratio, result in much transfer residue toner on the photosensitive member or intermediate transfer member and cause fog and image irregularity due to transfer failure. A toner having a weight-average particle size in excess of 8 μm is liable to result in lower resolution and dot-reproducibility and cause melt-sticking onto various members involved. These liabilities are promoted when the toner has a number-basis particle size variation coefficient in excess of 35%.

Figure 1:
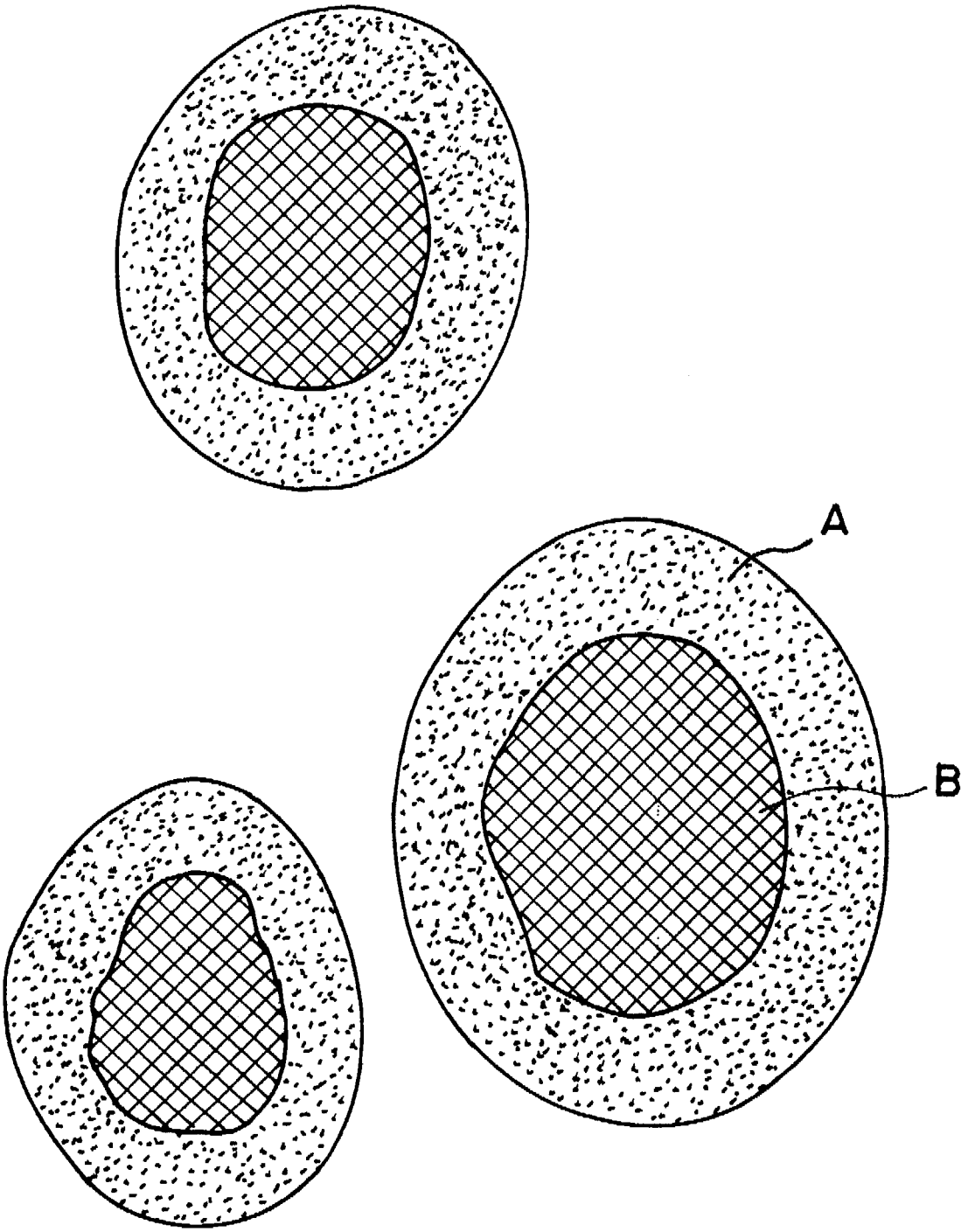
FIG. 1 is a microscopic schematic sectional view of toner particles obtained in Example 1 appearing hereinafter.

The toner particles constituting the toner of the present invention may suitably have a capsule structure comprising a core B of ester wax enclosed within an outer shell A of the binder resin as shown in FIG. 1 which is a sketch based on microscopic photographs of toner particles of Example 1 appearing hereinafter observed through a transmission electron microscope (TEM). The capsule structure of the toner is preferred in order to provide a good balance among low-temperature fixability, anti-blocking characteristic and durability of the toner.

In case of a toner not having an ester wax enclosure structure, the production thereof by pulverization cannot be effected without resort to a special freeze-pulverization technique, so that the toner can only be provided with a broad particle size distribution and can cause unpreferable melt-sticking onto the apparatus. On the other hand, the freeze-pulverization is accompanied with difficulties that a complicated apparatus is required so as to prevent moisture condensation thereto and the operability is liable to be lowered due to moisture absorption of the toner, thus requiring a drying step sometimes. As a specific method of enclosing the ester wax, it is possible to apply a polymerization process of using a combination of a monomer principally providing the binder resin and a minor amount of a polar polymer or polymer showing a higher polarity in an aqueous medium, thereby being able to provide a toner having a core-shell structure wherein even an ester wax having a large polarization can be encapsulated within an outer shell of the binder resin. A prescribed toner according to the present invention having a controlled particle size and a controlled distribution thereof may be obtained by appropriate selection of a barely water-soluble salt or dispersion agent having a protective colloid function and adjustment of addition amounts thereof, control of apparatus conditions, e.g., stirring conditions, such as rotor peripheral speed, number of passes and stirring blade shape, and vessel shape, and adjustment of solid matter content in the aqueous medium.

Figure 2:
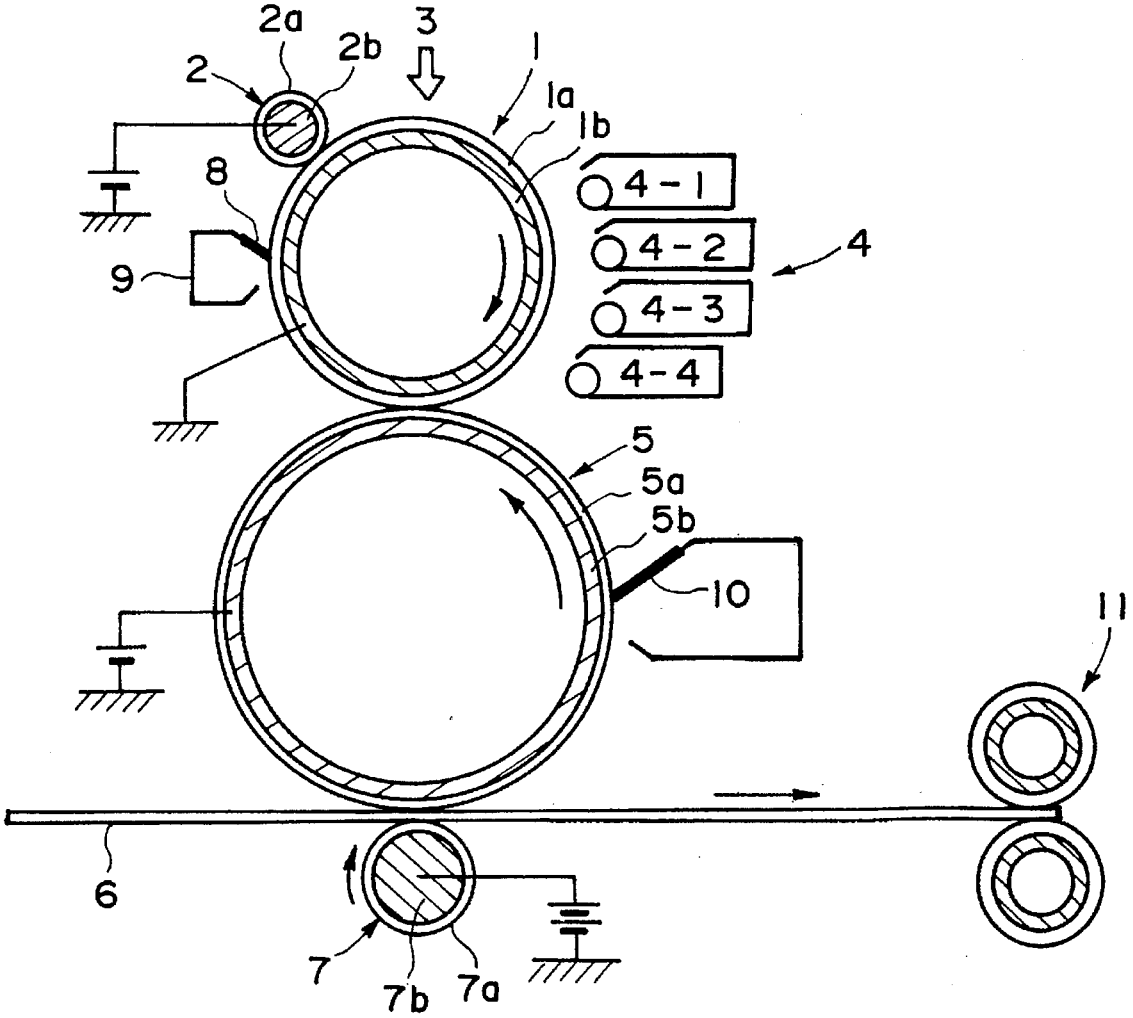
FIG. 2 is a schematic illustration of an image forming apparatus suitable for practicing an embodiment of the image forming method according to the present invention.

The cross-section of toner particles may be observed in the following manner. Sample toner particles are sufficiently dispersed in a cold-setting epoxy resin, which is then hardened for 2 days at 40° C. The hardened product is dyed with triruthenium tetroxide optionally together with triosmium tetroxide and sliced into thin flakes by a microtome having a diamond cutter. The resultant thin flake sample is observed through a transmission electron microscope (TEM) to confirm a sectional structure of toner particles. The dyeing with triruthenium tetroxide may preferably be used in order to provide a contrast between the low-softening point compound and the outer resin by utilizing a difference in crystallinity therebetween. A typical preferred cross-section of toner particles is shown in FIG. 2, wherein the ester wax B is enclosed within the outer shell resin A.

The toner according to the present invention may preferably be blended with external additives inclusive of: lubricant powder, such as polytetrafluoroethylene powder, zinc stearate powder, and polyvinylidene fluoride powder; abrasives, such as cerium oxide, silicon carbide, and strontium titanate; flowability improvers, such as silica, titanium oxide, and aluminum oxide; anti-caking agents; and electroconductivity-imparting agents, such as carbon black, zinc oxide, and tin oxide.

It is particularly preferred to add inorganic fine powder, such as fine powder of silica, titanium oxide or aluminum oxide. It is preferred that the inorganic fine has been hydrophobized with a hydrophobicity-imparting agent, such as a silane coupling agent, silicone oil or a combination thereof.

Such an external additive may ordinarily be added in an amount of 0.1–5 wt. parts per 100 wt. parts of the toner particles.

The toner according to the present invention may be used to constitute a one component-type developer or a two component-type developer.

In order to constitute a one component-type developer, a magnetic material may be incorporated in the toner particles to constitute a magnetic toner. In a one component type developing method, such a magnetic toner may be carried to be conveyed and charged on a developing sleeve enclosing a magnet. In another developing method, a non-magnetic toner containing no magnetic material may be applied onto a developing sleeve by means of a coating blade, a coating roller or a fur brush so as to forcibly triboelectrically charge the toner to form and convey a layer of charged toner on the developing sleeve.

In case where the toner according to the present invention is used for constituting a two-component type developer, the toner is used together with a carrier. The carrier need not be restricted particularly but may principally comprise a magnetic ferrite of elements such as iron, copper, zinc, nickel, cobalt, manganese and chromium, or a magnetic composite of such ferrites. The carrier particles may be shaped spherical, flat or irregular in view of the saturation magnetization and electrical resistivity. The surface microscopic structure, such as surface unevenness, of the carrier may also be controlled desirably. Generally, the above-mentioned inorganic oxide or ferrite may be calcined, and formed into core particles, which may be then coated with a resin. However, it is possible to produce a low-density dispersion type carrier by kneading the inorganic oxide and a resin, followed by pulverization and classification, so as to reduce the load of the carrier onto the toner; or to produce a true-spherical dispersion carrier by subjecting a mixture of the inorganic oxide and a monomer to suspension polymerization in an aqueous medium.

It is particularly preferred to provide a carrier coated with a resin. The coating may for example be performed by dissolving or dispersing a coating resin in a solvent, followed by attachment onto carrier, or by powder mixing of the coating resin with the carrier.

Examples of the coating material firmly applied onto the carrier core particles may include: polytetrafluoroethylene, monochlorotrifluoroethylene polymer, polyvinylidene fluoride, silicone resin, polyester resin, styrene resin, acrylic resin, polyamide, polyvinyl butyral, nigrosine, and aminoacrylate resin. These coating materials may be used singly or in combination of plural species.

The coating material may be applied onto the core particles in a proportion of 0.1–30 wt. %, preferably 0.5–20 wt. %, based on the carrier core particles. The carrier may preferably have an average particle size of 10–100 μm, more preferably 20–50 μm.

A particularly preferred type of carrier may comprise particles of a magnetic ferrite such as Cu-Zn-Fe ternary ferrite surface-coated with a fluorine-containing resin or a styrene-based resin. Preferred coating materials may include mixtures of a fluorine containing resin and a styrene copolymer, such as a mixture of polyvinylidene fluoride and styrene-methyl methacrylate resin, and a mixture of polytetrafluoroethylene and styrene-methyl methacrylate resin. The fluorine-containing resin may also be a copolymer, such as vinylidene fluoride/tetrafluoroethylene (10/90–90/10) copolymer. Other examples of the styrene-based resin may include styrene/2-ethylhexyl acrylate (20/80–80/20) copolymer and styrene/2-ethylhexyl acrylate/methyl methacrylate (20–60/5–30/10–50) copolymer. The fluorine-containing resin and the styrene-based resin may be blended in a weight ratio of 90:10–20:80, preferably 70:30–30:70.

The above-mentioned coated magnetic ferrite carrier shows a preferable triboelectric charging performance for the toner according to the invention and provides a two-component type developer with improved electrophotographic performances.

The toner according to the invention and a carrier may be blended in such a ratio as to provide a toner concentration of 2–15 wt. %, preferably 4–13 wt. %, whereby good results are obtained ordinarily.

The carrier may preferably have a magnetization at 1000 Oersted after magnetic saturation ($\sigma_{1000}$) of 30–300 emu/cm$^3$, further preferably 100–250 emu/cm$^3$, for high quality image formation. In excess of 300 emu/cm$^3$, there is a tendency that it is difficult to obtain high-quality toner images. Below 30 emu/cm$^3$, carrier attachment is liable to occur because of decreased magnetic constraint.

Hereinbelow, the image forming method according to the present invention will be explained more specifically with reference to FIG. 2.

Referring to FIG. 2, an image forming apparatus principally includes a photosensitive member 1 as an electrostatic image-bearing member, a charging roller 2 as a charging means, a developing device 4 comprising four developing units 4-1, 4-2, 4-3 and 4—4, an intermediate transfer member 5, a transfer roller 7 as a transfer means, and a fixing device 11 as a fixing means.

Four developers comprising cyan toner particles, magenta toner particles, yellow toner particles, and black toner particles, respectively, are incorporated in the developing units 4-1 to 4—4, respectively. An electrostatic image is formed on the photosensitive member 1 and developed with the four color toner particles by a developing method, such as a magnetic brush developing system or a non-magnetic monocomponent developing system, whereby the respective toner images are formed on the photosensitive member 1. The photoconductive member 1 comprises a support 1*a* and a photosensitive layer 1*b* thereon comprising a photoconductive insulating substance, such as a-Si, CdS, $ZnO_2$, OPC (organic photoconductor), and a-Si (amorphous silicon). The photosensitive member 1 may preferably comprise an a-Si photosensitive layer or OPC photosensitive layer. The photosensitive member 1 is rotated in a direction of an arrow by a drive means (not shown).

The organic photosensitive layer may be composed of a single layer comprising a charge-generating substance and a charge-transporting substance or may be function-separation type photosensitive layer comprising a charge generation layer and a charge transport layer. The function-separation type photosensitive layer may preferably comprise an electroconductive support, a charge generation layer, and a charge transport layer arranged in this order. The organic photosensitive layer may preferably comprise a binder resin, such as polycarbonate resin, polyester resin or acrylic resin, because such a binder resin is effective in improving transferability and cleaning characteristic and is not liable to cause toner sticking onto the photosensitive member or filming of external additives.

In the present invention, a charging step may be performed by using a corona charger which is not in contact with the photosensitive member 1 or by using a contact charger, such as a charging roller. The contact charging as shown in FIG. 2 may preferably be used in view of efficiency of uniform charging, simplicity and a lower ozone-generating characteristic. The charging roller 2 comprises a core metal 2*b* and an electroconductive elastic layer 2*a* surrounding a periphery of the core metal 2*b*. The charging roller 2 is pressed against the photosensitive member 1 at a prescribed pressure (pressing force) and rotated conjointly with the rotation of the photosensitive member 1.

The charging step using the charging roller may preferably be performed under process conditions including an applied pressure of the roller of 5–500 g/cm, an AC voltage of 0.5–5 kVpp, an AC frequency of 50–5 kHz and a DC voltage of ±0.2–±1.5 kV in the case of applying AC voltage and DC voltage in superposition; and an applied pressure of the roller of 5–500 g/cm and a DC voltage of ±0.2–±1.5 kV in the case of applying DC voltage.

Other charging means may include those using a charging blade or an electroconductive brush. These contact charging means are effective in omitting a high voltage or decreasing the occurrence of ozone. The charging roller and charging blade each used as a contact charging means may preferably comprise an electroconductive rubber and may optionally comprise a releasing film on the surface thereof. The releasing film may comprise, e.g., a nylon-based resin, polyvinylidene fluoride (PVDF) or polyvinylidene chloride (PVDC).

The toner image formed on the photosensitive member is transferred to the intermediate transfer member 5 to which a voltage (e.g., ±0.1–±5 kV) is applied. It is also possible to transfer the toner image on the photosensitive member directly to a transfer-receiving member without such an intermediate transfer member.

The intermediate transfer member 5 comprises a pipe-like electroconductive core metal 5*b* and a medium resistance-elastic layer 5*a* (e.g., an elastic roller) surrounding a periphery of the core metal 5*b*. The core metal 5*b* can comprise a plastic pipe coated by electroconductive plating. The medium resistance-elastic layer 5*a* may be a solid layer or a foamed material layer in which an electroconductivity-imparting substance, such as carbon black, zinc oxide, tin oxide or silicon carbide, is mixed and dispersed in an elastic material, such as silicone rubber, teflon rubber, chloroprene rubber, urethane rubber or ethylene-propylene-diene terpolymer (EPDM), so as to control an electric resistance or a volume resistivity at a medium resistance level of $10^5$–$10^{11}$ ohm.cm, particularly $10^7$–$10^{10}$ ohm.cm. The intermediate transfer member 5 is disposed under the photosensitive member 1 so that it has an axis (or a shaft) disposed in parallel with that of the photosensitive member 1 and is in contact with the photosensitive member 1. The intermediate transfer member 5 is rotated in the direction of an arrow (counterclockwise direction) at a peripheral speed identical to that of the photosensitive member 1.

The respective color toner images are successively intermediately transferred to the peripheral surface of the intermediate transfer member 5 by an elastic field formed by applying a transfer bias to a transfer nip region between the photosensitive member 1 and the intermediate transfer member 5 at the time of passing through the transfer nip region.

After the intermediate transfer of the respective toner image, the surface of the intermediate transfer member 5 is cleaned, as desired, by a cleaning means 10 which can be attached to or detached from the image forming apparatus. In case where the toner image is placed on the intermediate transfer member 5, the cleaning means 10 is detached or released from the surface of the intermediate transfer member 5 so as not to disturb the toner image.

The transfer means (e.g., a transfer roller) 7 is disposed under the intermediate transfer member 5 so that it has an axis (or a shaft) disposed in parallel with that of the intermediate transfer member 5 and is in contact with the intermediate transfer member 5. The transfer means (roller) 7 is rotated in the direction of an arrow (clockwise direction) at a peripheral speed identical to that of the intermediate transfer member 5. The transfer roller 7 may be disposed so that it is directly in contact with the intermediate transfer member 5 or in contact with the intermediate transfer member 5 via a belt, etc. The transfer roller 7 may comprise an electroconductive elastic layer 7*a* disposed on a peripheral surface of a core metal 7*b*.

The intermediate transfer member 5 and the transfer roller 7 may comprise known materials as generally used. In the present invention, by setting the volume resistivity of the elastic layer 5*a* of the intermediate transfer member 5 to be higher than that of the elastic layer 7*b* of the transfer roller, it is possible to alleviate a voltage applied to the transfer roller 7. As a result, a good toner image is formed on the transfer-receiving material and the transfer-receiving material is prevented from winding about the intermediate transfer member 5. The elastic layer 5*a* of the intermediate transfer member 5 may preferably have a volume resistivity at least ten times that of the elastic layer 7*b* of the transfer roller 7.

The intermediate transfer member 5 may preferably comprise an elastic layer 5*a* having a hardness of 10–40 as measured by JIS K-6301. On the other hand, the transfer roller 7 may preferably comprise an elastic layer 7*a* having a hardness higher than that of the elastic layer 5*a* of the intermediate transfer member 5, more preferably a hardness of 41–80 as measured by JIS K-6301 for preventing the transfer-receiving material from winding about the intermediate transfer member 5. If the hardness of the elastic layer 7*a* of the transfer roller 7 is lower than that of the elastic layer 5*a* of the intermediate transfer member 5, a concavity (or a recess) is formed on the transfer roller side, thus being liable to cause the winding of the transfer-receiving material about the intermediate transfer member 5.

The transfer roller 7 may be rotated at the same or different peripheral speed as that of the intermediate transfer member 5. The transfer-receiving material 6 is conveyed to a nip, between the intermediate transfer member 5 and the transfer roller 7, at which a toner image on the intermediate transfer member 5 is transferred to the front surface of the transfer-receiving material 6 by applying a transfer bias having a polarity opposite to that of triboelectric charge of the toner particles to the transfer roller 7.

The transfer roller 7 may comprise materials similar to those constituting the charging roller 2. The transfer step may be performed under conditions including a pressure of the transfer roller of 5–500 g/cm and a DC voltage of ±0.2–±10 kV. More specifically, the transfer roller 7 may comprise a core metal 7*b* and an electroconductive elastic layer 7*a* comprising an elastic material having a volume resistivity of $10^6$–$10^{10}$ ohm.cm, such as polyurethane or ethylene-propylene-diene terpolymer (EPDM) containing an electroconductive substance, such as carbon, dispersed therein. A certain bias voltage (e.g., preferably of ±0.2–±10 kV) is applied to the core metal 7*b* by a constant-voltage supply.

The transfer-receiving material 6 is then conveyed to the fixing device 11 comprising two rollers including a heated roller enclosing a heating member (e.g., a halogen heater) and a pressure roller pressed against the heated roller at a prescribed pressure. The toner image on the transfer-receiving material 6 is passed between the heated roller and the pressure roller to fix the toner image on the transfer-receiving material 6 under application of heat and pressure. The fixing step may also be performed by applying heat to the toner image by the medium of a film by a heater.

After the transfer of the color toner images from the intermediate transfer member 5 to the transfer-receiving material 6, residual toner particles on the transfer roller 7 may be cleaned by a cleaning member, such as a fur-brush cleaner. In the present invention, a higher transfer efficiency (transfer ratio) can be attained by using the toner particles having a shape factor SF-1 of 100–160 (preferably 100–150, particularly 100–125), so that a cleaning member can be omitted.

Examples of preparation of ester waxes according to the present invention and comparative ester waxes will now be described.

[Preparation of Ester Waxes (according to the present invention)]

Each ester wax was prepared in the following manner.

Into a four-necked flask equipped with a Dimroth reflux condenser and a Dean-Stark water separator, 1740 wt. parts of benzene, 1300 wt. parts of long-chain alkyl-carboxylic acid, 1200 wt. parts of long-chain alkyl alcohol and 120 wt. parts of p-toluenesulfuric acid were charged and sufficiently stirred for dissolution. Then, the system was subjected to 5 hours of refluxing and then to azeotropic distillation by opening a valve of the water separator. After the distillation, the content in the flask was sufficiently washed with sodium hydrogen carbonate and dried, followed by distilling-off of the benzene. The resultant product was recrystallized, washed and purified to obtain an ester wax.

Figure 4:
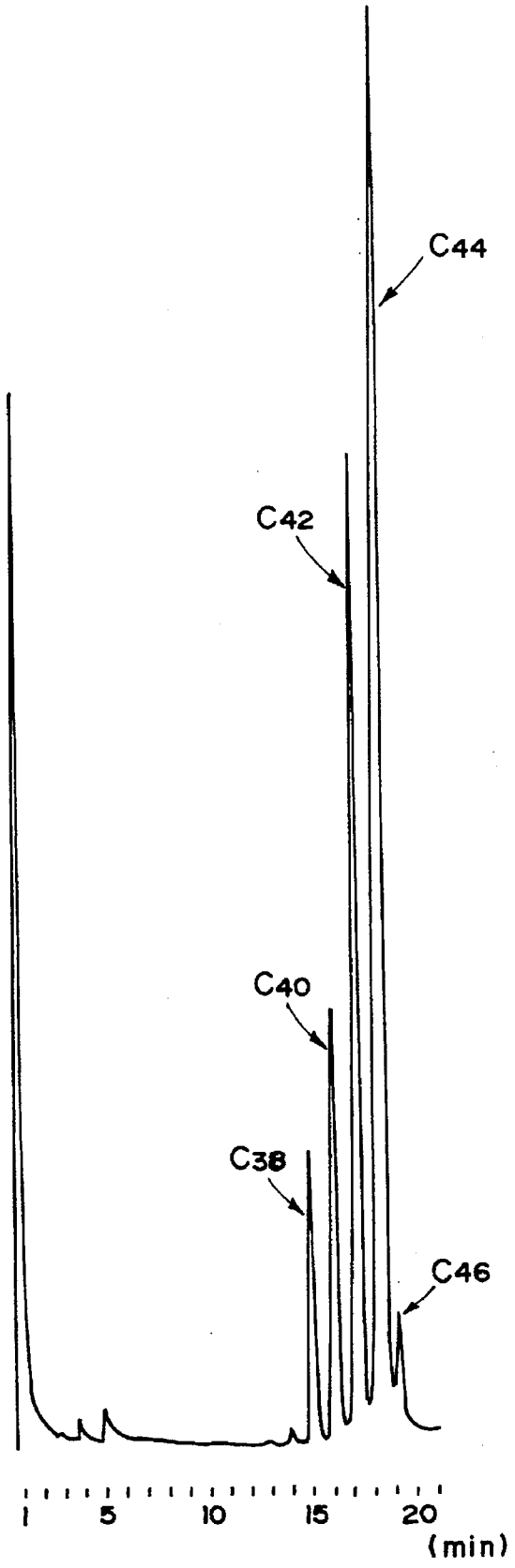

Various types of waxes (Ester waxes (A)–(H)) were prepared by changing the species of and relative amounts among the long-chain alkyl-carboxylic acid components and the long-chain alkyl alcohol components, respectively, while retaining the total amounts of the carboxylic acid and the alcohol, respectively, at constant value. The long-chain alkyl-carboxylic acid components and the long-chain alkyl alcohol components used are shown below, and several properties of the resultant ester waxes are indicated in Table 1 appearing hereinafter wherein the ester compounds contained are represented by their total number of carbon atoms. Ester wax (A), for example, provided a gas chromatogram as shown in FIG. 4.

Long-chain Alkyl-Carboxylic Acid Components

| | |
|---|---|
| palmitic acid | $C_{16}H_{32}O_2$ |
| stearic acid | $C_{18}H_{36}O_2$ |
| arachidic acid | $C_{20}H_{40}O_2$ |
| behenic acid | $C_{22}H_{40}O_2$ |
| lignoceric acid | $C_{24}H_{48}O_2$ |

Long-chain Alkyl Alcohol Components

| | |
|---|---|
| palmityl alcohol | $C_{16}H_{34}O$ |
| stearyl alcohol | $C_{18}H_{38}O$ |
| arachidic alcohol | $C_{20}H_{42}O$ |
| behenyl alcohol | $C_{22}H_{46}O$ |

[Preparation of Comparative Ester Waxes]

Comparative Ester Wax (a)

Comparative Ester wax (a) was prepared similarly as above but by changing the compositions of the long-chain alkyl-carboxylic acid components and the long-chain alkyl alcohol components (generally by reducing the amount of behenic acid and behenyl alcohol) so that the ester compounds having any one number of total carbon atoms were below 50 wt. % of the resultant ester wax.

Comparative Ester Wax (b)

Comparative Ester wax (b) was prepared similarly as above except for using behenic acid as the sole acid component and behenyl alcohol as the sole alcohol component.

The properties and compositions of Ester waxes (a) and (b) and contents of ester compounds contained are shown in Table 2.

TABLE 1

| Ester | Contents of ester compounds* (wt. %) | | | | | | | | | Melting point | | | |
|---|---|---|---|---|---|---|---|---|---|---|---|---|---|
| wax | C32 | C34 | C36 | C38 | C40 | C42 | C44 | C46 | Other | (°C.) | Hardness | Mw | Mn |
| (A) | 0 | 0 | 0 | 5.5 | 11.0 | 21.0 | 60.0 | 1.5 | 1.0 | 73.8 | 1.3 | 630 | 490 |
| (B) | 0 | 0 | 0 | 3.9 | 13.8 | 27.0 | 52.0 | 2.2 | 1.1 | 73.2 | 1.2 | 620 | 490 |
| (C) | 10.0 | 29.1 | 51.0 | 5.9 | 1.7 | 0 | 0 | 0 | 2.3 | 65.7 | 1.1 | 510 | 400 |
| (D) | 0 | 0 | 0 | 0.3 | 6.0 | 16.4 | 75.0 | 0.5 | 1.8 | 74.5 | 1.8 | 630 | 500 |
| (E) | 1.3 | 2.5 | 9.0 | 21.0 | 63.0 | 0.7 | 0 | 0 | 2.5 | 69.8 | 1.5 | 560 | 440 |
| (F) | 0 | 0 | 0 | 1.4 | 5.1 | 12.9 | 80.0 | 0.3 | 0.3 | 74.7 | 1.4 | 660 | 520 |
| (G) | 0 | 1.9 | 14.4 | 24.7 | 56.0 | 1.1 | 0 | 0 | 1.9 | 69.1 | 1.2 | 550 | 430 |
| (H) | 0 | 0.1 | 6.0 | 19.6 | 70.0 | 1.9 | 0 | 0 | 2.4 | 70.1 | 1.1 | 570 | 450 |

*Ester compounds contained are represented by the number of total carbon atoms.
For example, C44 represents ester compounds respectively having a total of 44 carbon atoms.

TABLE 2

| Ester | Contents of ester compounds* (wt. %) | | | | | | | | | Melting point | | | |
|---|---|---|---|---|---|---|---|---|---|---|---|---|---|
| wax | C32 | C34 | C36 | C38 | C40 | C42 | C44 | C46 | Other | (°C.) | Hardness | Mw | Mn |
| (a) | 0 | 0 | 5.2 | 5.8 | 13.8 | 27.0 | 40.0 | 2.7 | 5.5 | 72.9 | 1.3 | 590 | 460 |
| (b) | 0 | 0 | 0 | 0 | 0 | 0 | 100 | 0 | 0 | 76.7 | 1.9 | — | — |

*The same as in Table 1.

EXAMPLE 1

A cyan toner used in this example was prepared in the following manner.

Into a 2 liter-four necked flask equipped with a high-speed stirring device ("TK homomixer", mfd. by Tokushu Kika Kogyo K. K.), 710 wt. parts of deionized water and 450 wt. parts of 0.1M-$Na_3PO_4$ were added. The mixture was stirred at 12000 rpm and warmed at 65° C. Further, 68 wt. parts of 1.0M-$CaCl_2$ aqueous solution was added thereto to form an aqueous dispersion medium containing $Ca_3(PO_4)_2$ (fine dispersion stabilizer with little water-solubility).

| | |
|---|---|
| Styrene | 165 wt. parts |
| n-Butyl acrylate | 35 wt. parts |
| Cyan colorant (C.I. Pigment Blue 15:3) | 14 wt. parts |
| Polar resin (saturated polyester (terephthalic acid/propylene oxide-modified bisphenol A, acid value = 15, peak molecular weight (GPC) = 6000)) | 10 wt. parts |
| Charge control agent (metal-containing dialkyl salicylic acid compound) | 2 wt. parts |
| Ester wax (A) | 60 wt. parts |

The above ingredients were dispersed for 3 hours by an attritor. Into the mixture, 10 wt. parts of 2,2'-azobis(2,4-dimethylvaleronitrile) (polymerization initiator) was added, whereby a polymerizable monomer composition was prepared. The polymerizable monomer composition was added into the above aqueous dispersion medium and stirred at 12000 rpm for 15 minutes by the high-speed stirring device to disperse the polymerizable monomer composition into particles. The mixture was maintained at 60° C. and stirred at 200 rpm for 10 hours by a propeller blade stirring device to complete polymerization. After the polymerization, the resultant slurry was cooled, followed by addition of dilute hydrochloric acid to remove the dispersion stabilizer, washing and drying to recover electrically insulating cyan toner particles having a volume resistivity (Rv) of at least $10^{14}$ ohm.cm, a weight-average particle size (Dw) of 6 μm, a number-basis particle size variation coefficient (A) of 23%, and an SF-1 of 115.

The cyan toner particles were subjected to observation of cross-section thereof through a transmission electron microscope (TEM). The cross-section of the cyan toner particles showed a core-shell structure (as schematically illustrated in FIG. 1) in which the ester wax B was covered with an outer resin A (weight-average molecular weight (Mw) of 61,000 and number-average molecular weight (Mn) of 14,500).

EXAMPLES 2–4

Electrically insulating yellow toner (Example 2), magenta toner (Example 3) and black toner (Example 5) were prepared in the same manner as in Example 1 except for changing the colorant to C.I. Pigment Yellow 17, C.I. Pigment Red 202 and graft carbon black, respectively.

Several properties of the toners prepared in Examples 1–4 are shown in Table 3 appearing hereinafter.

Comparative Examples 1–4

Four color toners of cyan, yellow, magenta and black were prepared in the same manner as in Examples 1–4 except for using paraffin wax (Mw=550) instead of Ester wax (A). Properties of these comparative toners are shown in Table 4 below.

Comparative Examples 5–8

Four color toners of cyan, yellow, magenta and black were prepared in the same manner as in Examples 1–4 except for using polyethylene wax (Mw=1000) instead of Ester wax (A). Properties of these comparative toners are shown in Table 5 below.

Comparative Examples 9–12

Four color toners of cyan, yellow, magenta and black were prepared in the same manner as in Examples 1–4 except for using polypropylene wax (Mw=1100) instead of Ester wax (A). Properties of these comparative toners are shown in Table 6 below.

Comparative Examples 13–16

Four color toners of cyan, yellow, magenta and black were prepared in the same manner as in Examples 1–4 except for replacing Ester wax (A) with montan ester wax ("Montan Ester Wax E", mfd. by Hoechst A. G.) principally comprising ester compounds represented by the formula of $R_3$—$COO(CH_2$—$CH_2)_n$ $OOCR_4$ wherein $R_3$ and $R_4$ independently denote linear alkyl having 19–29 carbon atoms and n denotes an integer. Properties of these comparative toners are shown in Table 7 below.

TABLE 3

| Toner | Dw (μm) | A (%) | SF-1 | Wax, Content (wt. parts*) | Outer resin Mw ($\times 10^4$) | Outer resin Mn ($\times 10^4$) | Rv (Ω · cm) |
|---|---|---|---|---|---|---|---|
| Cyan (Ex. 1) | 6.0 | 23 | 115 | Ester, 28 | 6.1 | 1.45 | $\geqq 10^{14}$ |
| Yellow (Ex. 2) | 6.3 | 28 | 114 | Ester, 28 | 6.0 | 1.35 | $\geqq 10^{14}$ |
| Magenta (Ex. 3) | 6.2 | 25 | 113 | Ester, 28 | 6.2 | 1.40 | $\geqq 10^{14}$ |
| Black (Ex. 4) | 6.1 | 24 | 110 | Ester, 28 | 6.3 | 1.38 | $\geqq 10^{14}$ |

*per 100 wt. parts of the binder resin.

TABLE 4

| Toner | Dw (μm) | A (%) | SF-1 | Wax, Content (wt. parts*) | Outer resin Mw ($\times 10^4$) | Outer resin Mn ($\times 10^4$) | Rv (Ω · cm) |
|---|---|---|---|---|---|---|---|
| Cyan (Comp. Ex.1) | 6.3 | 30 | 112 | Paraffin, 28 | 6.05 | 1.40 | $\geqq 10^{14}$ |
| Yellow (Comp. Ex. 2) | 6.4 | 27 | 111 | Paraffin, 28 | 5.95 | 1.30 | $\geqq 10^{14}$ |
| Magenta (Comp. Ex. 3) | 6.7 | 26 | 114 | Paraffin, 28 | 6.15 | 1.35 | $\geqq 10^{14}$ |
| Black (Comp. Ex. 4) | 6.2 | 23 | 117 | Paraffin, 28 | 6.25 | 1.31 | $\geqq 10^{14}$ |

TABLE 5

| Toner | Dw (μm) | A (%) | SF-1 | Wax, Content (wt. parts*) | Outer resin Mw ($\times 10^4$) | Outer resin Mn ($\times 10^4$) | Rv (Ω · cm) |
|---|---|---|---|---|---|---|---|
| Cyan (Comp. Ex. 5) | 6.6 | 33 | 121 | Polyethylene, 28 | 6.3 | 1.6 | $\geqq 10^{14}$ |
| Yellow (Comp. Ex. 6) | 6.7 | 35 | 120 | Polyethylene, 28 | 6.2 | 1.5 | $\geqq 10^{14}$ |

TABLE 5-continued

| Toner | Dw (μm) | A (%) | SF-1 | Wax, Content (wt. parts*) | Outer resin Mw (×10⁴) | Outer resin Mn (×10⁴) | Rv (Ω · cm) |
|---|---|---|---|---|---|---|---|
| Magenta (Comp. Ex. 7) | 6.8 | 34 | 118 | Polyethylene, 28 | 6.05 | 1.35 | $\geqq 10^{14}$ |
| Black (Comp. Ex. 8) | 6.3 | 31 | 119 | Polyethylene, 28 | 6.15 | 1.4 | $\geqq 10^{14}$ |

TABLE 6

| Toner | Dw (μm) | A (%) | SF-1 | Wax, Content (wt. parts*) | Outer resin Mw (×10⁴) | Outer resin Mn (×10⁴) | Rv (Ω · cm) |
|---|---|---|---|---|---|---|---|
| Cyan (Comp. Ex. 9) | 6.5 | 35 | 119 | Polypropylene 28 | 6.3 | 1.55 | $\geqq 10^{14}$ |
| Yellow (Comp. Ex. 10) | 6.6 | 34 | 118 | Polypropylene 28 | 6.25 | 1.5 | $\geqq 10^{14}$ |
| Magenta (Comp. Ex. 11) | 6.9 | 34 | 117 | Polypropylene 28 | 6.1 | 1.35 | $\geqq 10^{14}$ |
| Black (Comp. Ex. 12) | 6.7 | 35 | 120 | Polypropylene 28 | 6.2 | 1.45 | $\geqq 10^{14}$ |

TABLE 7

| Toner | Dw (μm) | A (%) | SF-1 | Wax, Content (wt. parts*) | Outer resin Mw (×10⁴) | Outer resin Mn (×10⁴) | Rv (Ω · cm) |
|---|---|---|---|---|---|---|---|
| Cyan Comp. Ex. 13) | 6.6 | 27 | 111 | montan ester, 28 | 6.03 | 1.5 | $\geqq 10^{14}$ |
| Yellow (Comp. Ex. 14) | 6.3 | 26 | 115 | montan ester, 28 | 6.1 | 1.55 | $\geqq 10^{14}$ |
| Magenta (Comp. Ex. 15) | 6.2 | 23 | 113 | montan ester, 28 | 6.15 | 1.47 | $\geqq 10^{14}$ |
| Black (Comp. Ex. 16) | 6.4 | 29 | 114 | montan ester, 28 | 6.05 | 1.42 | $\geqq 10^{14}$ |

Comparative Example 17

A cyan toner was prepared in the same manner as in Example 1 except for changing the addition amount of Ester wax (A) to 4 wt. parts. The resultant cyan toner contained 1.9 wt. parts of Ester wax (A) per 100 wt. parts of the binder resin.

Comparative Example 18

A cyan toner was prepared in the same manner as in Example 1 except for changing the addition amount of Ester wax (A) to 110 wt. parts. The resultant cyan toner contained 52 wt. parts of Ester wax (A) per 100 wt. parts of the binder resin.

Comparative Example 19

A cyan toner was prepared in the same manner as in Example 1 except for using Comparative Ester wax (a) in place of Ester wax (A).

Comparative Example 20

A cyan toner was prepared in the same manner as in Example 1 except for using Comparative Ester wax (b) in place of Ester wax (A).

EXAMPLE 5

Each of the cyan toner, yellow toner, magenta toner and black toner was externally blended with 2 wt. % of hydrophobic titanium oxide fine particles to provide four color toners having an improved flowability. Further, each of the four color toners thus obtained in an amount of 6 wt. parts was blended with 94 wt. parts of resin-coated magnetic ferrite carrier having an average particle size of 50 μm to prepare four two-component type color developers.

The thus-prepared four color developers were charged in developing devices 4-1, 4-2, 4-3 and 4—4, respectively, of an image forming apparatus having a sectional view as shown in FIG. 2 and including an intermediate transfer member 5.

Referring to FIG. 2, a photosensitive member 1 comprising a support 1*a* and a photosensitive layer 1*b* disposed thereon containing an organic photosemiconductor was rotated in the direction of an arrow and charged so as to have a surface potential of about −600 V by a charging roller 2 (comprising an electroconductive elastic layer 2*a* and a core metal 2*b*). An electrostatic image having a light (exposure) part potential of −100 V and a dark part potential of −600 V was formed on the photosensitive member 1 by exposing the photosensitive member 1 to light-image 3 by using an image exposure means effecting ON and OFF based on digital image information through a polygonal mirror. The electrostatic image was developed with yellow toner particles, magenta toner particles, cyan toner particles or black toner particles contained in plural developing units 4-1 to 4—4 by using reversal development to form color toner images on the photosensitive member 1. Each of the color toner images was transferred to an intermediate transfer member 5 (comprising an elastic layer 5*a* and a core metal 5*b* as a support) to form thereon a superposed four-color image. Residual toner particles on the photosensitive member 1 after the transfer are recovered by a cleaning member 8 to be contained in a residual toner container 9. This cleaning step can be performed by a simple bias roller or by not using the cleaning member without causing a problem since sphere-shaped toner particles used in the present invention a higher transfer efficiency than irregular-shaped toner particles.

The intermediate transfer member 5 was formed by applying a coating liquid for the elastic layer 5*a* comprising carbon black (as an electroconductivity-imparting material) sufficiently dispersed in acrylonitrile-butadiene rubber (NBR) onto a pipe-like core metal 5*b*. The elastic layer 5*a* of the intermediate transfer member 5 showed a hardness of 30 degrees as measured by JIS K-6301 and a volume resistivity (Rv) of $10^9$ ohm.cm. The transfer from the photosensitive member 1 to the intermediate transfer member 5 was performed by applying a voltage of +500 V from a power supply to the core metal 5*b* to provide a necessary transfer current of about 5 μA.

The superposed four-color image was then transferred to a transfer-receiving material 6 by using a transfer roller 7 having a diameter of 20 mm. The transfer roller 7 was formed by applying a coating liquid for the elastic layer 7*a* comprising carbon (as an electroconductivity-imparting material) sufficiently dispersed in a foamed ethylene-propylene-diene terpolymer (EPDM) onto a 10 mm dia.-core metal 7*b*. The elastic layer 7*a* of the transfer roller 7 showed a hardness of 35 degrees as measured by JIS K-6301 and a volume resistivity of $10^6$ ohm.cm. The transfer from the intermediate transfer member 5 to the transfer-receiving material 6 was performed by applying a voltage to the transfer roller 7 to provide a transfer current of 15 μA.

Thus, the respective color toner images were formed by the respective color developers contained in the respective developing units (4-1 to 4—4) under the above-described conditions. The respective color toners showed triboelectric charges of −15 to −18 μc/g.

The respective toner images formed on the photosensitive member 1 were successively transferred to an intermediate transfer member 5 and further transferred to a transfer-receiving material 6 (plain paper having a basis weight of 199 g/m$^2$) to form a superposed four-color toner image on the transfer-receiving material 6. After each of the above transfer of the color toner images from the intermediate transfer member 5 to the transfer-receiving material 6, the surface of the intermediate transfer member 5 was successively cleaned by a cleaning member 10. The transferred superposed four-color toner image was subjected to heat fixation by using a fixing means 10 utilizing application of heat and pressure.

Each of the thus formed four color toner images showed a high transfer efficiency including a transfer ratio ($T_1$) (from the photosensitive member to the image transfer member) of 95–98%, a transfer ratio ($T_2$) (from the intermediate transfer member to the transfer-receiving material) of 99%, and an overall transfer ratio ($T_{overall}$) (from the photosensitive member to the transfer-receiving material through the intermediate transfer member) of 94.1–97.0%. The resultant toner image was also excellent in color-mixing characteristic and was a high quality image free from hollow transfer failure. Further, when double-side image formation was performed, an occurrence of an offset phenomenon on both sides of a transfer-receiving material was not observed. When a copying test of 50,000 sheets (durability test) was performed, an image density of the resultant image was not changed between at an initial stage and after the durability test and toner sticking onto the respective members of the image forming apparatus was not caused.

EXAMPLE 6

Four two-component type color developers for magnetic brush development were prepared by using the cyan toner, yellow toner, magenta toner and black toner prepared in Examples 1–4, respectively, in the same manner as in Example 5, and charged and used in developing devices of a digital full-color copying machine ("CLC-500", mfd. by Canon K. K.) to form images on plain paper and an OHP film according to monochromatic modes and a full color mode to evaluate the fixability, anti-offset characteristic, color mixing temperature range, and transparency (clarity) of the toners. The items were respectively evaluated in the following manner.

1) Fixability, Anti-offset characteristic and Color-mixing range:

The developer was used in a commercially available copier (i.e., "CLC-500" by Canon) to form yet-unfixed images.

If the toner was a black toner, the unfixed toner images were subjected to fixation by an external hot roller fixing device equipped with no oil applicator, thereby evaluating the fixability and anti-offset characteristic of the toner.

If the toner was a color toner for providing monochromatic or full-color images, the unfixed images were subjected to fixation by an external hot roller fixing device equipped with no oil applicator, or fixation by the fixing device of the commercially available full-color copier ("CLC-5000" available from Canon K. K.) while applying a small amount of oil (e.g., 0.02 g/A4-size) onto a fixing roller, thereby evaluating the fixability, anti-offset characteristic and color-mixing range and also obtaining a fixed toner image for evaluation of the transparency.

The fixing rollers had surface layers of a fluorine-containing resin. The hot roller fixing device had a lower roller and an upper roller each having a roller diameter of ca. 60 mm and surfaced with fluorine containing resin. The fixing conditions included a nip of 6.5 mm and a process speed of 105 mm/sec for fixation on plain paper (e.g., "SK paper, mfd. by Nippon Seishi K. K.), and a nip of 6.5 mm and a process speed of 25 mm/sec for fixation on an OHP sheet (e.g., "CG3200", mfd. by 3M Co.). The fixation test on the plain paper was performed in the temperature range of 80°–230° C. under temperature control while changing the temperature at an increment of 5° C. each. The fixation test on the OHP film was performed at a constant temperature of 150° C.

The fixability was evaluated by rubbing a fixed toner image (in a sense of including an image having caused low-temperature offset) with a lens cleaning paper ("Dasper (R)", mfd. by Ozu Paper, Co., Ltd.) at a load of 50 g/cm$^2$, and the fixability was evaluated in terms of a fixing initiation temperature $T_{FI}$ (° C.) at or above which the density decrease of the image after the rubbing was below 10%.

The anti-offset characteristic was evaluated in terms a lower limit temperature (lower offset initiation temperature) at or above which offset was unobservable and a higher limit temperature (higher offset terminating temperature) at or below which offset was unobservable, respectively by eye observation.

The color-mixing range was evaluated by measuring the gloss of the fixed images obtained in the non-offset region by a handy gloss checker ("IG-310", mfd. by Horiba Seisakusho K. K.) and evaluated in terms of the range between the lower limit temperature and the higher limit temperature, wherein the gloss value was 7 or higher.

2) Transparency (or clarity)

The transmittance and haze were measured with respect to fixed toner images at varying image densities, and the transparency was evaluated by the transmittance Tp [%] and haze [–] at an image density of 1.2. The transmittance Tp [%] and haze [–] were measured in the following manner.

The transmittance Tp [%] of an OHP image was measured relative to that of an OHP sheet per se as Tp=100% by using an auto-recording spectrophotometer at maximum absorption wavelengths for the respective toners (i.e., 650 nm for a magenta toner, 500 nm for a cyan toner, and 600 nm for a yellow toner).

The haze [–] was measured by using a haze meter ("NDH-300A", mfd. by Nippon Hasshoku Kogyo K. K.).

The results of evaluation are shown in Tables 8–10 appearing hereinafter.

Evaluation of Comparative Toners

Two-component type developers of various colors for magnetic brush development were prepared by using color toners of Comparative Examples 1–20 in the same manner as in Example 5, and evaluated in a similar manner as in Example 6.

The color-mixing characteristic was evaluated by using four sets of toners, i.e., Comparative Example A (including four color toner of Comparative Examples 1–4), Comparative Example B (Comparative Examples 5–8), Comparative Example C (Comparative Examples 9–12) and Comparative Example D (Comparative Examples 13–16).

The cyan toners of Comparative Examples 17–20 were evaluated only according to the monochromatic mode.

The results of the evaluation are also shown in tables 8–10.

TABLE 8

| Color toner of Example or Comp. Example | | Fixed images on OHP film | |
|---|---|---|---|
| | | Transparency (%) | Haze [–] |
| Cyan | (Ex. 1) | 68 | 29 |
| Yellow | (Ex. 2) | 64 | 33 |
| Magenta | (Ex. 3) | 66 | 31 |
| Cyan | (Comp. Ex. 1) | 31 | 65 |
| Yellow | (Comp. Ex. 2) | 27 | 69 |
| Magenta | (Comp. Ex. 3) | 29 | 67 |
| Cyan | (Comp. Ex. 5) | 19 | 73 |
| Yellow | (Comp. Ex. 6) | 15 | 77 |
| Magenta | (Comp. Ex. 7) | 18 | 75 |
| Cyan | (Comp. Ex. 9) | 18 | 72 |
| Yellow | (Comp. Ex. 10) | 14 | 76 |
| Magenta | (Comp. Ex. 11) | 16 | 74 |
| Cyan | (Comp. Ex. 13) | 33 | 67 |
| Yellow | (Comp. Ex. 14) | 29 | 70 |
| Magenta | (Comp. Ex. 15) | 32 | 69 |
| Cyan | (Comp. Ex. 17) | ** | ** |
| Cyan | (Comp. Ex. 18) | 39 | 55 |
| Cyan | (Comp. Ex. 19) | 51 | 51 |
| Cyan | (Comp. Ex. 20) | 64 | 35 |

**Evaluation was impossible as the OHP film was wound about the upper roller.

TABLE 9

| Four color toner set (color toners) | (Color-mixing characteristic according to full-color mode) | | |
|---|---|---|---|
| | Lower limit temp. (°C.) | Upper limit temp. (°C.) | Non-offset temp. range (°C.) |
| Example 6 (Ex. 1–4) | 130 | 210 | 140–190 |
| Comp. Example A (Comp. Ex. 1–4) | 130 | 210 | 140–190 |
| Comp. Example B (Comp. Ex. 5–8) | 140 | 220 | 150–200 |
| Comp. Example C (Comp. Ex. 9–12) | 145 | 225 | 155–205 |
| Comp. Example D (Comp. Ex. 13–16 | 130 | 220 | 140–175 |

TABLE 10

| Cyan toner of Example or Comp. Example | $T_{FI}$ (°C.) | Anti-offset | | |
|---|---|---|---|---|
| | | Lower limit temp. (°C.) | Upper limit temp. (°C.) | Non-offset temp. range (°C.) |
| Ex. 1 | 130 | 130 | 210 | 80 |
| Comp. Ex. 1 | 135 | 130 | 210 | 80 |
| Comp. Ex. 5 | 145 | 140 | 220 | 80 |

TABLE 10-continued

| Cyan toner of Example or Comp. Example | $T_{FI}$ (°C.) | Anti-offset | | |
|---|---|---|---|---|
| | | Lower limit temp. (°C.) | Upper limit temp. (°C.) | Non-offset temp. range (°C.) |
| Comp. Ex. 9 | 150 | 145 | 225 | 80 |
| Comp. Ex. 13 | 135 | 130 | 200 | 70 |
| Comp. Ex. 17 | 130 | 130 | 145 | 15 |
| Comp. Ex. 18 | 130 | 130 | 220 | 90 |
| Comp. Ex. 19 | 135 | 130 | 210 | 80 |
| Comp. Ex. 20 | 130 | 130 | 210 | 80 |

EXAMPLES 7–13

Cyan toners were prepared in the same manner as in Example 1 except for using Ester waxes (B) to (H), respectively, instead of Esters wax (A). The resultant cyan toners were respectively formulated into two-component type color developers for magnetic brush development and evaluated in the same manner as in Example 6. The results are shown in the following Tables 11 and 12.

TABLE 11

| Example | Ester | Fixed images on OHP film | |
|---|---|---|---|
| | | Transparency (%) | Haze [–] |
| 7 | B | 65 | 32 |
| 8 | C | 64 | 33 |
| 9 | D | 71 | 26 |
| 10 | E | 68 | 28 |
| 11 | F | 73 | 23 |
| 12 | G | 66 | 31 |
| 13 | H | 69 | 27 |

TABLE 12

| Example | Ester wax | $T_{FI}$ (°C.) | Anti-offset | | |
|---|---|---|---|---|---|
| | | | Lower limit temp. (°C.) | Upper limit temp. (°C.) | Non-offset temp. range (°C.) |
| 7 | B | 130 | 130 | 210 | 80 |
| 8 | C | 130 | 130 | 200 | 70 |
| 9 | D | 130 | 130 | 210 | 80 |
| 10 | E | 130 | 130 | 205 | 75 |
| 11 | F | 130 | 130 | 210 | 80 |
| 12 | G | 130 | 130 | 205 | 75 |
| 13 | H | 130 | 130 | 205 | 75 |

What is claimed is:

1. A toner for developing electrostatic images, comprising: at least a binder resin, a colorant and an ester wax; wherein said ester wax is contained in 3–40 wt. parts per 100 wt. parts of the binder resin, said ester wax comprises ester compounds represented by a formula of $$R_1—COO—R_2,$$

wherein $R_1$ and $R_2$ independently denote a hydrocarbon group of 15–45 carbon atoms, and said ester wax contains 50–95 wt. % thereof of ester compounds having an identical number of total carbon atoms.

2. The toner according to claim 1, wherein $R_1$ denotes a saturated hydrocarbon group.

3. The toner according to claim 2, wherein $R_1$ denotes an alkyl group.

4. The toner according to claim 1, wherein $R_2$ denotes a saturated hydrocarbon group.

5. The toner according to claim 1, wherein $R_2$ denotes an alkyl group.

6. The toner according to claim 1, wherein $R_1$ and $R_2$ respectively denote a hydrocarbon group.

7. The toner according to claim 6, wherein $R_1$ and $R_2$ respectively denote an alkyl group.

8. The toner according to claim 1, wherein $R_1$ denotes a linear alkyl group having 15–45 carbon atoms and $R_2$ denotes a linear alkyl group having 15–45 carbon atoms.

9. The toner according to claim 1, wherein the ester wax has a melting point of 40°–90° C.

10. The toner according to claim 9, wherein the ester wax has a melting point of 55°–85° C.

11. The toner according to claim 1, wherein the ester wax has a hardness of 0.5–5.0.

12. The toner according to claim 1, wherein the ester wax is contained in 5–35 wt. parts per 100 wt. parts of the binder resin.

13. The toner according to claim 1, wherein the ester wax has a weight-average molecular weight (Mw) of 200–2000 and a number-average molecular weight (Mn) of 150–2000.

14. The toner according to claim 1, wherein the ester wax contains 55–95 wt. % of the ester compounds having an identical number of total carbon atoms.

15. The toner according to claim 14, wherein the ester wax contains 60–95 wt. % of the ester compounds having an identical number of total carbon atoms.

16. The toner according to claim 1, wherein the ester wax contains totally 80–95 wt. % thereof of ester compounds having total carbon atoms in a range of number of said identical number ±2.

17. The toner according to claim 16, wherein the ester wax contains totally 90–95 wt. % thereof of ester compounds having total carbon atoms in a range of number of said identical number ±2.

18. The toner according to claim 1, wherein the ester wax contains totally 50–90 wt. % thereof of ester compounds represented by $R_1'$—COO—$R_2'$ (wherein $R_1'$ and $R_2'$ independently denote a linear long-chain alkyl group having 15–28 carbon atoms) and having totally 44 carbon atoms.

19. The toner according to claim 1, wherein said binder resin contains a tetrahydrofuran (THF)-soluble content which has a number-average molecular weight (Mn) of $5\times10^3$–$10^6$ and a ratio (Mw/Mn) of weight-average molecular weight (Mw)/number-average molecular weight (Mn) of 2–100.

20. The toner according to claim 1, wherein the ester wax is enclosed within the binder resin.

21. The toner according to claim 1, wherein the colorant comprises a cyan colorant.

22. The toner according to claim 1, wherein the colorant comprises a magenta colorant.

23. The toner according to claim 1, wherein the colorant comprises a yellow colorant.

24. The toner according to claim 1, which is in the form of toner particles which have been prepared directly from a monomer composition comprising at least a polymerizable monomer providing the binder resin, the colorant, the ester wax and a polymerization initiator in an aqueous medium.

25. The toner according to claim 24, wherein the toner particles comprise cyan color toner particles.

26. The toner according to claim 24, wherein the toner particles comprise magenta color toner particles.

27. The toner according to claim 24, wherein the toner particles comprise yellow color toner particles.

28. The toner according to claim 24, wherein the ester wax contains 55–95 wt. % of the ester compounds having an identical number of total carbon atoms.

29. The toner according to claim 28, wherein the ester wax contains 60–95 wt. % of the ester compounds having an identical number of total carbon atoms.

30. The toner according to claim 28 or 29, wherein the ester wax contains 50–95 wt. % thereof in total of ester compounds, each having totally 44 carbon atoms and represented by the formula of $R_1'$—COO—$R_2'$ wherein $R_1'$ and $R_2'$ independently denote a linear long-chain alkyl group having 15–28 carbon atoms.

31. The toner according to claim 1, which has a shape factor SF-1 of 100–160.

32. The toner according to claim 31, which has a shape factor SF-1 of 100–150.

33. The toner according to claim 1, which has a weight-average particle size of 3–8 μm, and a number-basis particle size variation coefficient of at most 35%.

34. An image forming method, comprising:

forming an electrostatic image on an electrostatic image-bearing member, developing the electrostatic image with a toner to form a toner image on the electrostatic image-bearing member, transferring the toner image from the electrostatic image-bearing member to a transfer-receiving material directly or via an intermediate transfer member, and fixing the toner image onto the transfer-receiving material under application of heat and pressure, wherein said toner comprises at least a binder resin, a colorant and an ester wax; wherein said ester wax is contained in 3–40 wt. parts per 100 wt. parts of the binder resin, said ester wax comprises ester compounds represented by a formula of $$R_1\text{—COO—}R_2,$$

wherein $R_1$ and $R_2$ independently denote a hydrocarbon group of 15–45 carbon atoms, and said ester wax contains 50–95 wt. % thereof of ester compounds having an identical number of total carbon atoms.

35. The method according to claim 34, wherein said transfer-receiving material is caused to carry toner images at least two colors selected from the group consisting of cyan, magenta, yellow and black.

36. The method according to claim 34 or 35, wherein $R_1$ denotes a saturated hydrocarbon group.

37. The method according to claim 36, wherein $R_1$ denotes an alkyl group.

38. The method according to claim 34 or 35, wherein $R_2$ denotes a saturated hydrocarbon group.

39. The method according to claim 38, wherein $R_2$ denotes an alkyl group.

40. The method according to claim 34 or 35, wherein $R_1$ and $R_2$ respectively denote a hydrocarbon group.

41. The method according to claim 40, wherein $R_1$ and $R_2$ respectively denote an alkyl group.

42. The method according to claim 34 or 35, wherein $R_1$ denotes a linear alkyl group having 15–45 carbon atoms and $R_2$ denotes a linear alkyl group having 15–45 carbon atoms.

43. The method according to claim 34 or 35, wherein the ester wax has a melting point of 40°–90° C.

44. The method according to claim 43, wherein the ester wax has a melting point of 55°–85° C.

45. The method according to claim 34 or 35, wherein the ester wax has a hardness of 0.5–5.0.

46. The method according to claim 34 or 35, wherein the ester wax is contained in 5–35 wt. parts per 100 wt. parts of the binder resin.

47. The method according to claim 34 or 35, wherein the ester wax has a weight-average molecular weight (Mw) of 200–2000 and a number-average molecular weight (Mn) of 150–2000.

48. The method according to claim 34 or 35, wherein the ester wax contains 55–95 wt. % of the ester compounds having an identical number of total carbon atoms.

49. The method according to claim 48, wherein the ester wax contains 60–95 wt. % of the ester compounds having an identical number of total carbon atoms.

50. The method according to claim 34 or 35, wherein the ester wax contains totally 80–95 wt. % thereof of ester compounds having total carbon atoms in a range of number of said identical number ±2.

51. The method according to claim 50, wherein the ester wax contains totally 90–95 wt. % thereof of ester compounds having total carbon atoms in a range of number of said identical number ±2.

52. The method according to claim 34 or 35, wherein the ester wax contains totally 50–90 wt. % thereof of ester compounds represented by $R_1'$—COO—$R_2'$ (wherein $R_1'$ and $R_2'$ independently denote a linear long-chain alkyl group having 15–28 carbon atoms) and having totally 44 carbon atoms.

53. The method according to claim 34 or 35, wherein said binder resin contains a tetrahydrofuran (THF)-soluble content which has a number-average molecular weight (Mn) of $5\times10^3$–$10^6$ and a ratio (Mw/Mn) of weight-average molecular weight (Mw)/number-average molecular weight (Mn) of 2–100.

54. The method according to claim 34 or 35, wherein the ester wax is enclosed within the binder resin.

55. The method according to claim 34 or 35, wherein the colorant comprises a cyan colorant.

56. The method according to claim 34 or 35, wherein the colorant comprises a magenta colorant.

57. The method according to claim 34 or 35, wherein the colorant comprises a yellow colorant.

58. The method according to claim 34 or 35, which is in the form of toner particles which have been prepared directly from a monomer composition comprising at least a polymerizable monomer providing the binder resin, the colorant, the ester wax and a polymerization initiator in an aqueous medium.

59. The method according to claim 58, wherein the toner particles comprise cyan color toner particles.

60. The method according to claim 58, wherein the toner particles comprise magenta color toner particles.

61. The method according to claim 58, wherein the toner particles comprise yellow color toner particles.

62. The method according to claim 58, wherein the ester wax contains 55–95 wt. % of the ester compounds having an identical number of total carbon atoms.

63. The method according to claim 62, wherein the ester wax contains 60–95 wt. % of the ester compounds having an identical number of total carbon atoms.

64. The method according to claim 62, wherein the ester wax contains 50–95 wt. % thereof in total of ester compounds, each having totally 44 carbon atoms and represented by the formula of $R_1'$—COO—$R_2'$ wherein $R_1'$ and $R_2'$ independently denote a linear long-chain alkyl group having 15–28 carbon atoms.

65. The method according to claim 34 or 35, which has a shape factor SF-1 of 100–160.

66. The method according to claim 65, which has a shape factor SF-1 of 100–150.

67. The method according to claim 34 or 35, which has a weight-average particle size of 3–8 μm, and a number-basis particle size variation coefficient of at most 35%.

* * * * *

UNITED STATES PATENT AND TRADEMARK OFFICE

CERTIFICATE OF CORRECTION

PATENT NO. : 5,635,325

DATED : June 3, 1997

INVENTOR(S) : KOHJI INABA ET AL.

It is certified that error appears in the above-identified patent and that said Letters Patent is hereby corrected as shown below:

ON THE TITLE PAGE, ITEM [57] ABSTRACT
Line 6, "an" should read --and--.

COLUMN 2
Line 19, "above mentioned" should read --above-mentioned--.
Line 41, "an" should read --and--.

COLUMN 3
Line 17, "s" should be deleted;
Line 39, "gassified" should read --gasified--.

COLUMN 5
Line 3, "16-44" should read --15-45--.

COLUMN 7
Line 24, "the" should read --if the--;
Line 43, "solution) The" should read --solution). The--.

COLUMN 8
Line 2, "yellow" should read --a yellow--;
Line 54, "naphtoic" should read --naphthoic--.

COLUMN 9
Line 10, "azobisisbutyronitrile," should read --azobisisobutyronitrile--.
Line 49, "watersoluble" should read --water-soluble--.

UNITED STATES PATENT AND TRADEMARK OFFICE

CERTIFICATE OF CORRECTION

PATENT NO. : 5,635,325

DATED : June 3, 1997

INVENTOR(S) : KOHJI INABA ET AL.

It is certified that error appears in the above-identified patent and that said Letters Patent is hereby corrected as shown below:

COLUMN 10
Line 44, "or/and" should read --and/or--.

COLUMN 13
Line 1, "fine" should read --fine powder--;
Line 12, "component type" should read --component-type--.

COLUMN 14
Line 30, "4—4," should read --4—4,--;
Line 36, "4—4," should read --4-4,--.

COLUMN 17
Line 30, "constant" should read --a constant--.

COLUMN 18
Line 63, "manner." should read --manner:--.

COLUMN 22
Line 22, "4—4," should read --4-4,--;
Line 40, "4—4," should read --4-4,--;
Line 51, "invention" should read --invention provide--.

COLUMN 23
Line 14, "4—4)" should read --4-4)--.

UNITED STATES PATENT AND TRADEMARK OFFICE

CERTIFICATE OF CORRECTION

PATENT NO. : 5,635,325

DATED : June 3, 1997

INVENTOR(S) : KOHJI INABA ET AL.

It is certified that error appears in the above-identified patent and that said Letters Patent is hereby corrected as shown below:

COLUMN 24
Line 36, "terms" should read --terms of--.

COLUMN 26
Line 19, "Esters" should read --Ester--.

COLUMN 28
Line 50, "images" should read --images of--.

Signed and Sealed this

Ninth Day of December, 1997

Bruce Lehman

*Attest:*

BRUCE LEHMAN

*Attesting Officer*

*Commissioner of Patents and Trademarks*